US012207739B1

(12) United States Patent
Wang

(10) Patent No.: US 12,207,739 B1
(45) Date of Patent: Jan. 28, 2025

(54) MULTI-FUNCTIONAL CHAIR AND EXERCISE KIT

(71) Applicant: NAN YA PLASTICS CORPORATION, Taipei (TW)

(72) Inventor: Kuei-Yung Wang, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 0 days.

(21) Appl. No.: 18/918,024

(22) Filed: Oct. 16, 2024

(30) Foreign Application Priority Data

May 14, 2024 (TW) ..... 113204877

(51) Int. Cl.
*A47C 7/62* (2006.01)
*A47C 1/00* (2006.01)
*A63B 23/04* (2006.01)

(52) U.S. Cl.
CPC ..... *A47C 7/62* (2013.01); *A47C 1/00* (2013.01); *A63B 23/0476* (2013.01); *A63B 2208/0233* (2013.01)

(58) Field of Classification Search
CPC ..... A47C 1/00; A47C 7/62; A63B 23/0476; A63B 2208/0233
See application file for complete search history.

(56) References Cited

U.S. PATENT DOCUMENTS 5,807,212 A * 9/1998 Nelson ..... A63B 21/1609 482/904
7,128,700 B2 * 10/2006 Wallach ..... A63B 21/4035 482/121
7,445,586 B2 * 11/2008 Gibson ..... A63B 23/0494 482/148
8,007,423 B2 * 8/2011 Solow ..... A63B 21/4047 482/148
9,149,678 B2 * 10/2015 Shauli ..... A47C 9/002
9,339,679 B2 * 5/2016 Ertl ..... A63B 21/4034
9,403,049 B2 * 8/2016 Harada ..... A63B 21/169
9,533,190 B2 * 1/2017 Walkama ..... A63B 26/00
9,573,012 B1 * 2/2017 Lee ..... A63B 23/03525
9,757,611 B1 * 9/2017 Colburn ..... A63B 21/0051
11,547,895 B1 * 1/2023 Wang ..... A47C 9/002
11,583,719 B2 * 2/2023 Weisz ..... A63B 23/03541
11,771,231 B1 * 10/2023 Wang ..... A47C 9/002 297/313

* cited by examiner

*Primary Examiner* — Philip F Gabler

(74) *Attorney, Agent, or Firm* — Li & Cai Intellectual Property Office

(57) ABSTRACT

A multi-functional chair and an exercise kit are provided. The multi-functional chair includes a seat body, a chair leg module, and the exercise kit. The exercise kit includes a plurality of fixing members, a fixing seat, a supporting structure, two pedal modules, and two springs. The supporting structure is connected to the fixing seat. Each of the pedal modules includes one of two rotating components, one of two connecting arms, and one of two pedals. One of the rotating components is rotatably connected to the supporting structure. One end of the connecting arms is fixed to the rotating component. One of the pedals is connected to another end of the connecting arms. One end of each of the two springs is fixed to the supporting structure, another end of each of the two springs are respectively fixed to each of the two connecting arms.

26 Claims, 22 Drawing Sheets

MULTI-FUNCTIONAL CHAIR AND EXERCISE KIT

CROSS-REFERENCE TO RELATED PATENT APPLICATION

This application claims the benefit of priority to Taiwan Patent Application No. 113204877, filed on May 14, 2024. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a multi-functional chair and an exercise kit, and more particularly to a multi-functional chair that allows a user to exercise thereon and an exercise kit that can be mounted on the multi-functional chair using casters.

BACKGROUND OF THE DISCLOSURE

A conventional office chair does not provide for a user to exercise therewith.

SUMMARY OF THE DISCLOSURE

In response to the above-referenced technical inadequacy, the present disclosure provides a multi-functional chair to improve the issue that a conventional office chair cannot provide for a user to exercise.

In order to solve the above-mentioned problems, one of the technical aspects adopted by the present disclosure is to provide a multi-functional chair. The multi-functional chair includes a seat body, a chair leg module, and an exercise kit. The seat body is for a user to be seated thereon. The chair leg module includes a chair leg and a lifting component. The chair leg is provided with a plurality of casters and a plurality of braking mechanisms, and each of the braking mechanisms is operable by the user to restrict rotation of the casters. The lifting component is connected to the seat body and the chair leg, the lifting component is operable by the user to lift or lower the seat body relative to the chair leg, and the lifting component includes a pneumatic rod. The exercise kit is detachably connected to the chair leg module, the exercise kit is disposed under the seat body, and the exercise kit includes a plurality of fixing members, a fixing seat, a supporting structure, two pedal modules, and two springs. Each of the fixing members includes at least one auxiliary fixing component and at least one locking component. The fixing seat includes a hollow sleeve and a connecting plate. The hollow sleeve is connected to the connecting plate, the hollow sleeve is configured to be sleeved on an outer side of the pneumatic rod, the connecting plate is disposed at one side of the chair leg facing toward the seat body, multiple ones of the auxiliary fixing component are disposed at another side of the chair leg opposite to the seat body, and multiple ones of the locking component are configured to fix the multiple ones of the auxiliary fixing component and the connecting plate with each other, such that the connecting plate and the multiple ones of the auxiliary fixing component are jointly fixed to the chair leg. The supporting structure is connected to the fixing seat. Each of the pedal modules includes one of two rotating components, one of two connecting arms, and one of two pedals. One of the two rotating components is rotatably connected to the supporting structure. One end of one of the connecting arms is fixed to one of the rotating components. One of the two pedals is connected to another end of one of the connecting arms. Each of the two pedals is provided for the user sitting on the seat body to step thereon. One end of each of the two springs is fixed to the supporting structure, another end of each of the two springs are fixed to one of the two connecting arms. When any one of the two pedals is stepped on by the user, one of the corresponding connecting arms and one of the corresponding pedals are rotated relative to the supporting structure, and one of the corresponding springs is stretched.

In order to solve the above-mentioned problems, another one of the technical aspects adopted by the present disclosure is to provide an exercise kit for being fixed to an activity chair. The activity chair includes a seat body and a chair leg module, the seat body is for a user to be seated thereon, the chair leg module includes a chair leg and a lifting component, the chair leg is provided with a plurality of casters and a plurality of braking mechanisms, and each of the braking mechanisms is operable by the user to restrict rotation of the casters. The lifting component is connected to the seat body and the chair leg, and the lifting component is operable by the user to lift or lower the seat body relative to the chair leg. The exercise kit is detachably connected to the chair leg module, the exercise kit is disposed under the seat body, and the exercise kit includes a plurality of fixing members, a fixing seat, a supporting structure, two pedal modules, and two springs. Each of the fixing members includes at least one auxiliary fixing component and at least one locking component. The fixing seat includes a hollow sleeve and a connecting plate. The hollow sleeve is connected to the connecting plate, the hollow sleeve is configured to be sleeved on an outer side of the pneumatic rod, the connecting plate is disposed at one side of the chair leg facing toward the seat body, multiple ones of the auxiliary fixing component are disposed at another side of the chair leg opposite to the seat body, and multiple ones of the locking component are configured to fix the multiple ones of the auxiliary fixing component and the connecting plate with each other, such that the connecting plate and the multiple ones of the auxiliary fixing component are jointly fixed to the chair leg. The supporting structure is connected to the fixing seat. Each of the pedal modules includes one of two rotating components, one of two connecting arms, and one of two pedals. One of the two rotating components is rotatably connected to the supporting structure. One end of one of the two connecting arms is fixed to one of the two rotating component. One of the two pedals is connected to another end of one of the two connecting arms. Each of the two pedals is provided for the user sitting on the seat body to step thereon. One end of each of the two springs is fixed to the supporting structure, another end of each of the two springs are fixed to one of the two connecting arms. When any one of the two pedals is stepped on by the user, one of the corresponding connecting arms and one of the corresponding pedals are rotated relative to the supporting structure, and one of the corresponding springs is stretched.

Therefore, the multi-functional chair and the exercise kit provided by the present disclosure allow the user sitting on the chair to use the exercise kit for exercising and training their legs.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
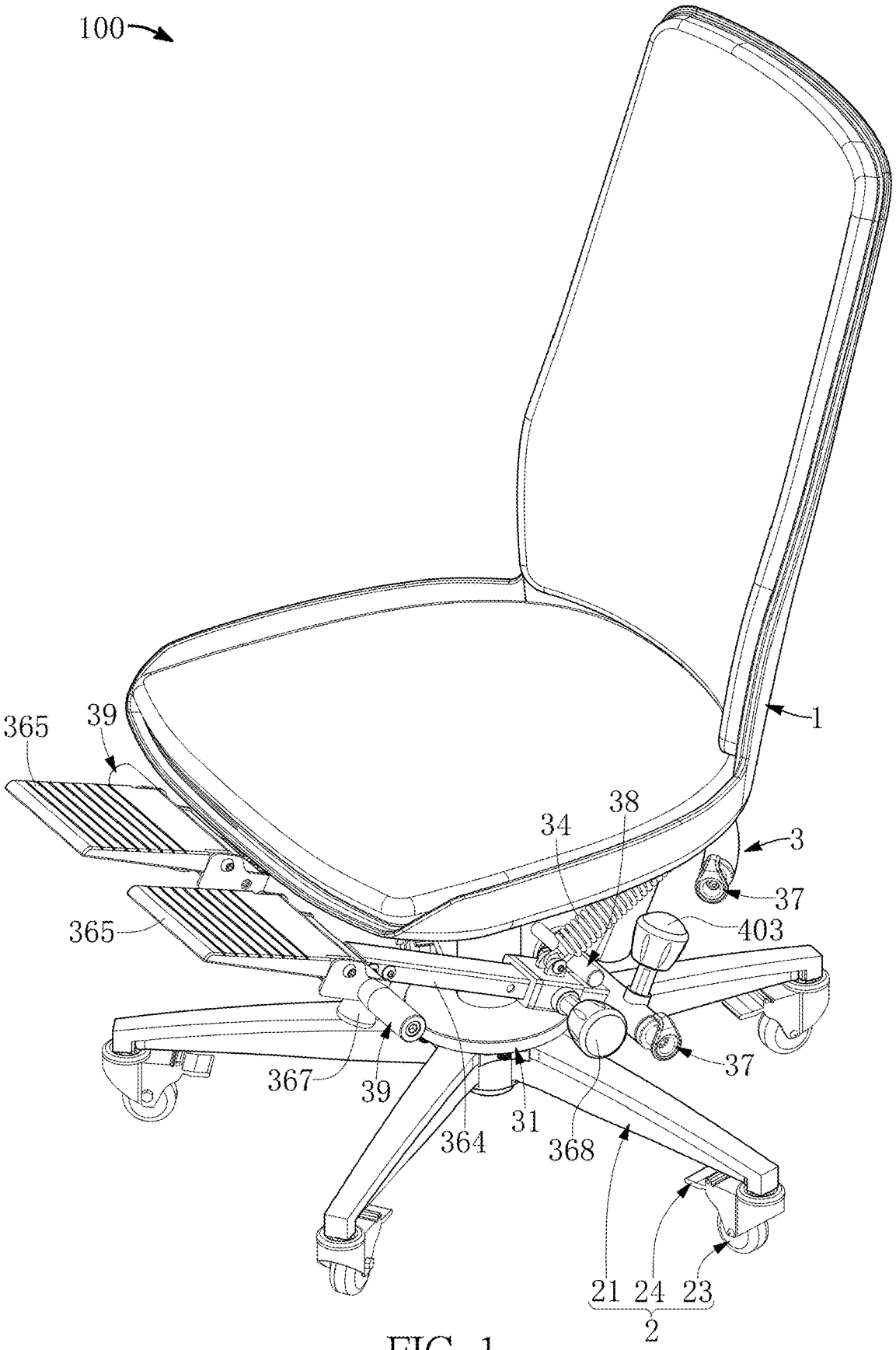
FIG. 1 to FIG. 3 are schematic perspective views of a multi-functional chair in different angles according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a," "an" and "the" includes plural reference, and the meaning of "in" includes "in" and "on." Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first," "second" or "third" can be used to describe various components, signals or the like, which are for distinguishing one component/signal from another one only, and are not intended to, nor should be construed to impose any substantive limitations on the components, signals or the like.

First Embodiment

Figure 2:
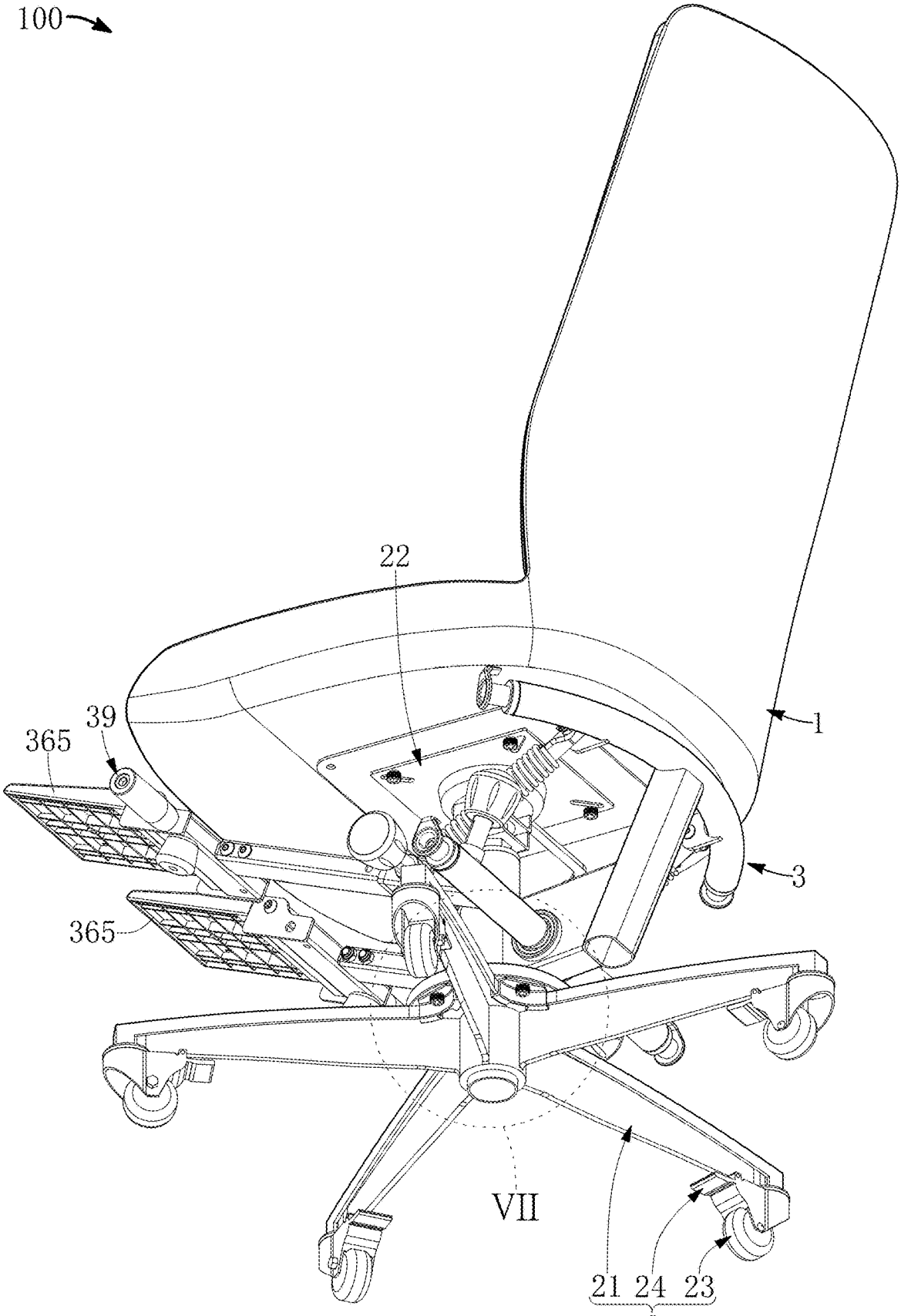
Figure 3:
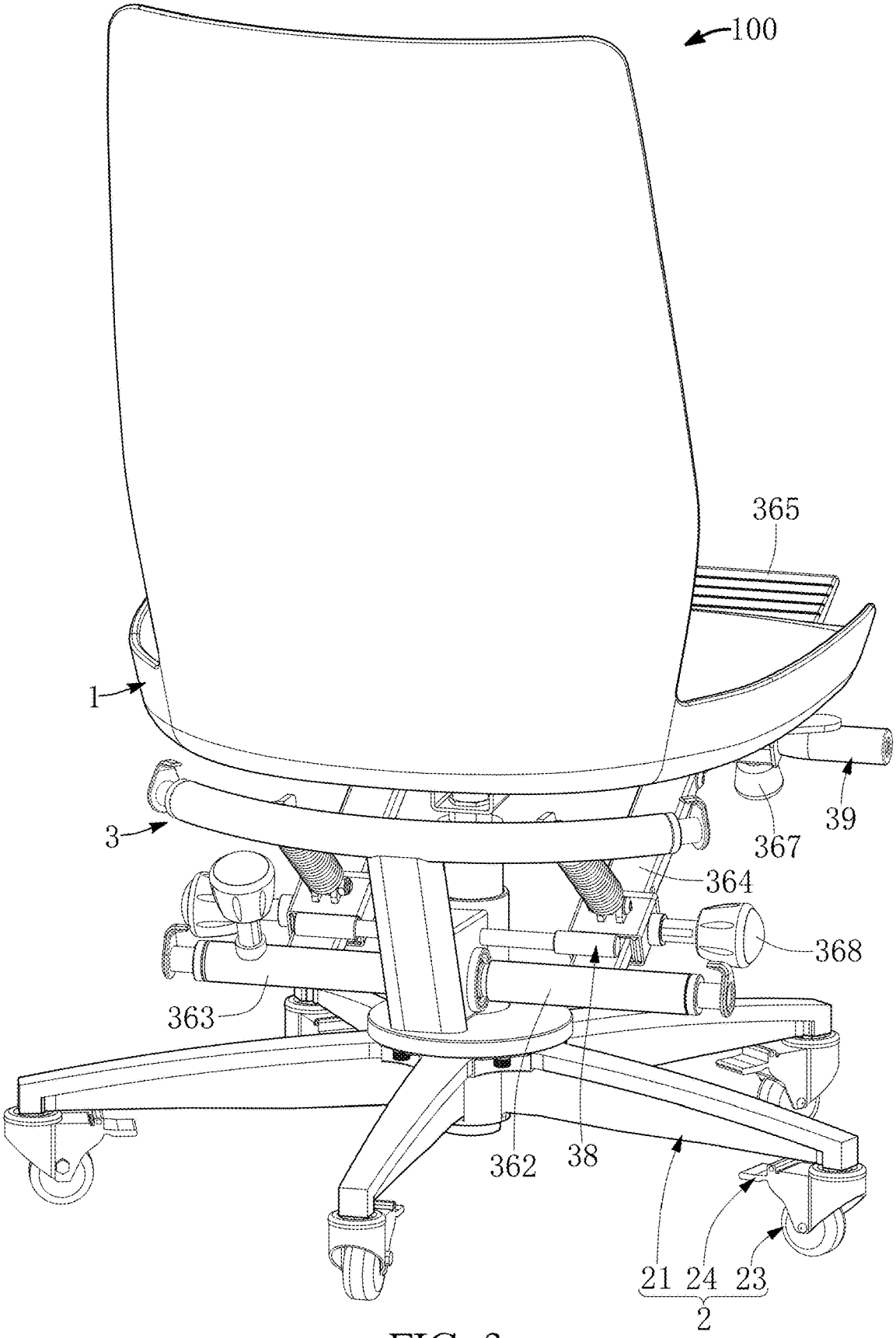
Figure 4:
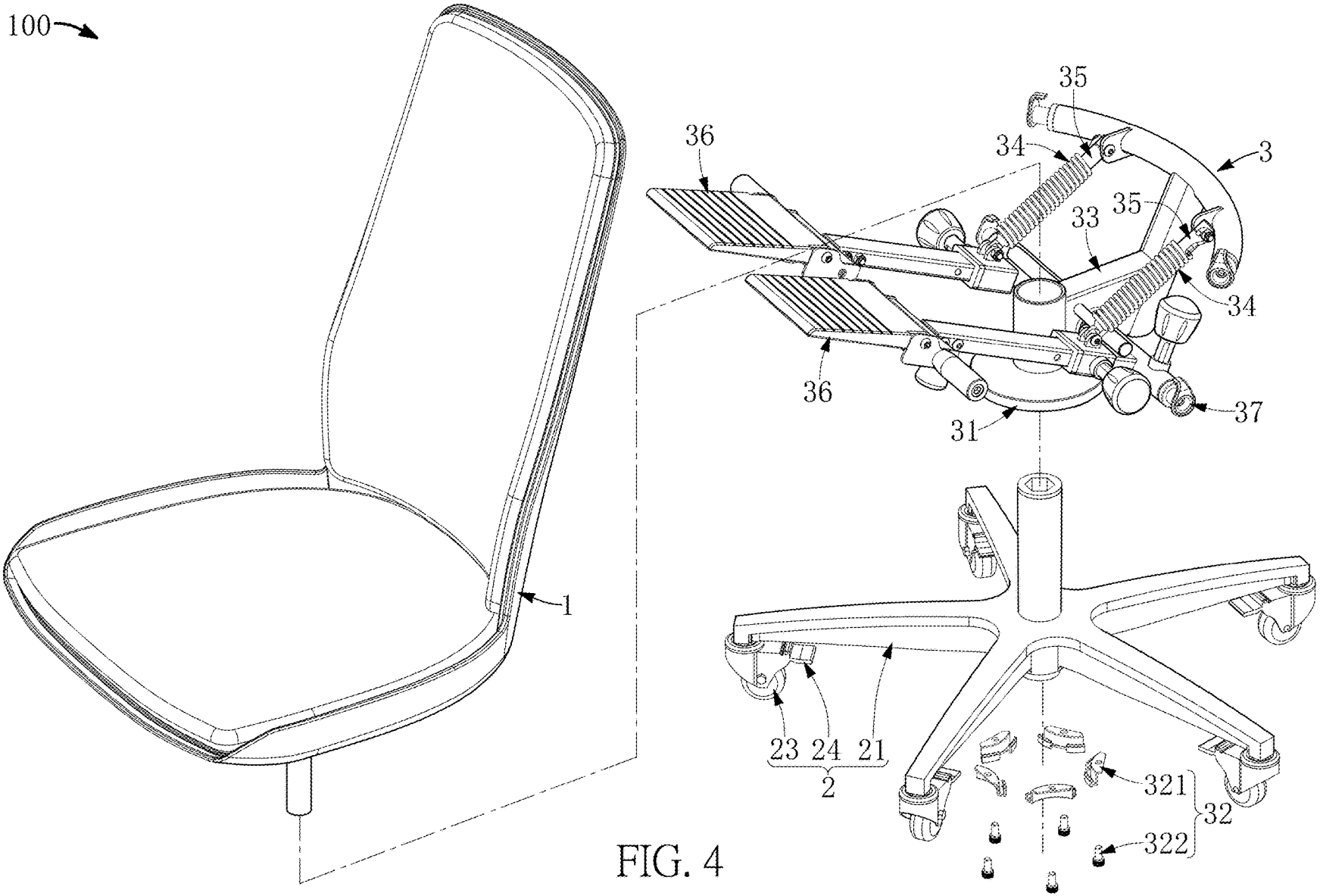
FIG. 4 is a schematic exploded view of the multi-functional chair according to the embodiment of the present disclosure.
Figure 5:
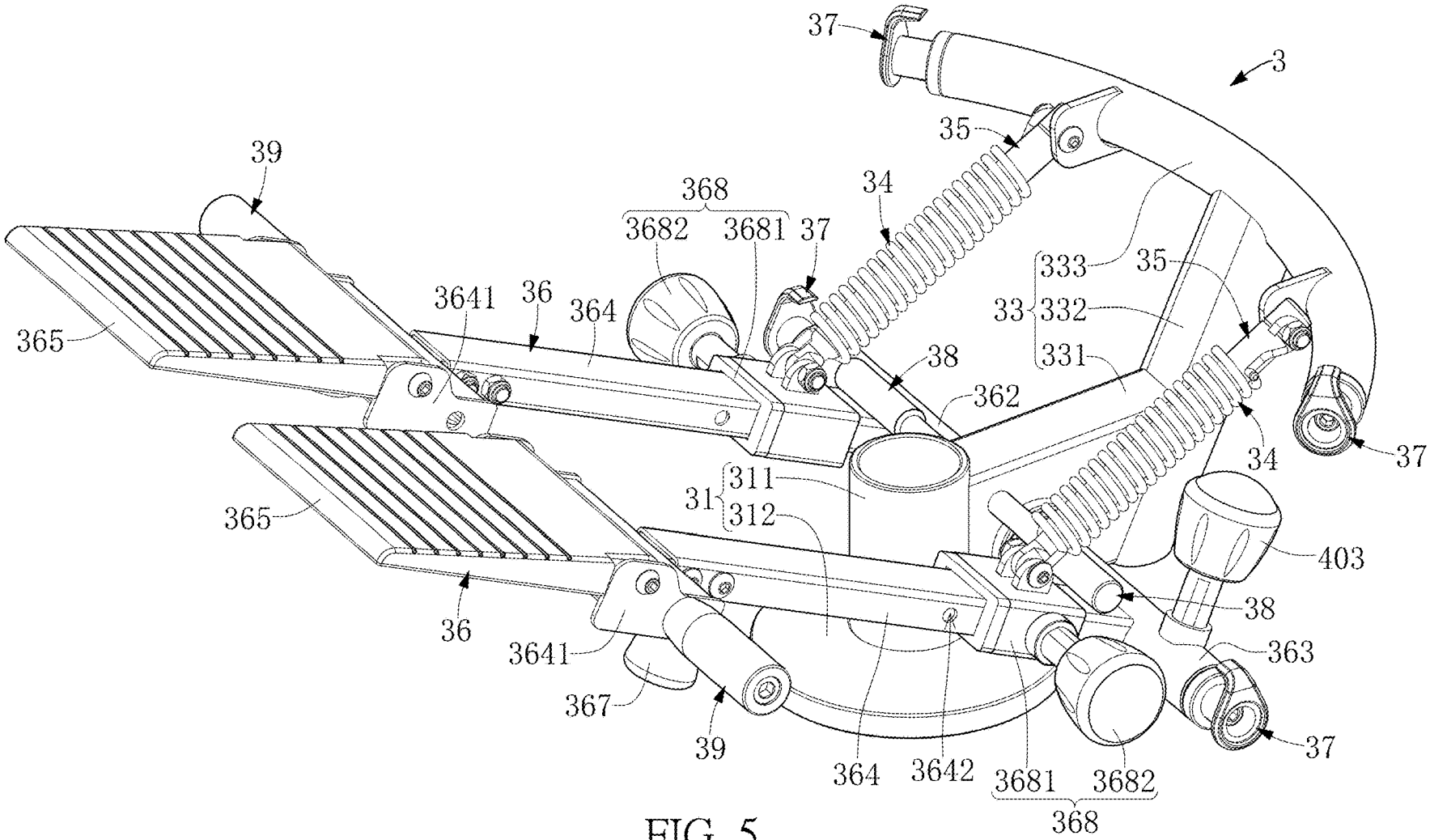
FIG. 5 and FIG. 6 are schematic perspective views of an exercise kit of the multi-functional chair in different angles according to the embodiment of the present disclosure.
Figure 6:
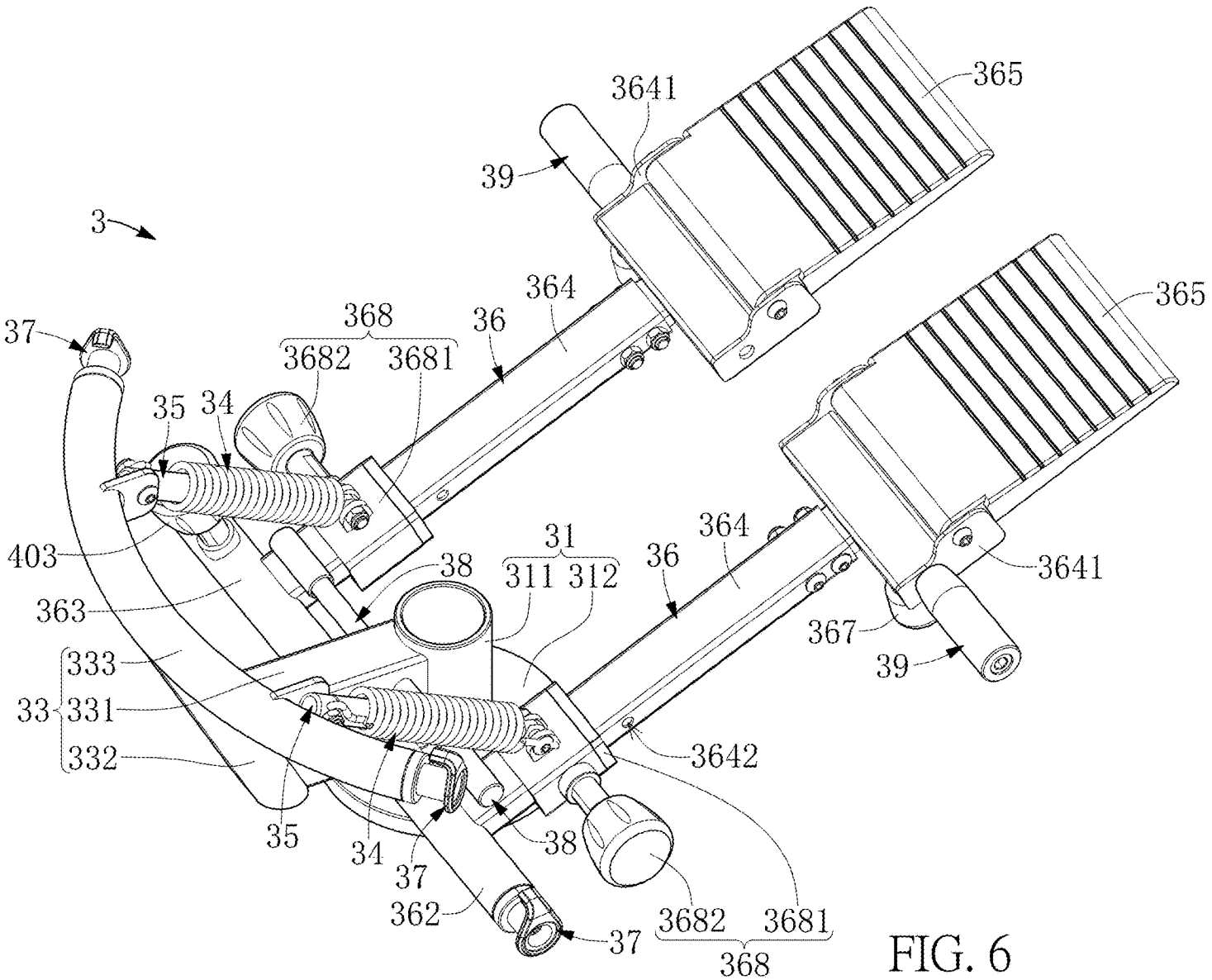

As shown in FIG. 1 to FIG. 6, FIG. 1 to FIG. 3 are schematic perspective views of a multi-functional chair in different angles according to an embodiment of the present disclosure, FIG. 4 is a schematic exploded view of the multi-functional chair according to the embodiment of the present disclosure, and FIG. 5 and FIG. 6 are schematic perspective views of an exercise kit of the multi-functional chair in different angles according to the embodiment of the present disclosure.

The multi-functional chair 100 of the present embodiment includes a seat body 1, a chair leg module 2, and an exercise kit 3. The seat body 1 is used for a user to be seated thereon. The seat body 1 can be provided with a soft object, such as a cushion and/or a backrest. The chair leg module 2 includes a chair leg 21 and a lifting component 22. The chair leg 21 can have a five-claw structure, but a quantity of claws of the chair leg 21 is not limited to five, and can be adjusted according to practical requirements. The chair leg 21 is provided with five casters 23 and five braking mechanisms 24, and each of the braking mechanisms 24 is operable by the user to restrict rotation of the casters 23. The lifting component 22 is connected to the seat body 1 and the chair leg 21, and the lifting component 22 is operable by the user to lift or lower the seat body 1 relative to the chair leg. The lifting component 22 can, for example, include a pneumatic rod.

It should be noted that each of the casters 23 of the chair leg 21 is connected to the braking mechanisms 24. Therefore, when the user uses the exercise kit 3 to exercise, the user can use each of the braking mechanisms 24 to prevent all the casters 23 from moving. Accordingly, the multi-functional chair 100 does not slide during exercise.

The seat body 1 and the chair leg module 2 referred to herein can be parts of conventional office chairs. The exercise kit 3 is detachably disposed under the seat body 1. In other words, the exercise kit 3 of the present embodiment is detachably mounted under the conventional office chair, and connected to the chair leg 21.

As shown in FIG. 2, FIG. 5, FIG. 6 and FIG. 7, the exercise kit 3 includes a fixing seat 31, five fixing members 32, a supporting structure 33, two springs 34, two damping rods 35, two pedal modules 36, and a plurality of hook components 37. In different embodiments, the exercise kit 3 can include none of the damping rods 35 and/or the hook components 37.

The fixing seat 31 includes a hollow sleeve 311 and a connecting plate 312. One end of the hollow sleeve 311 is configured to be sleeved on an outer side of the pneumatic rod of the lifting component 22. Another end of the hollow sleeve 311 is connected to the connecting plate 312. The connecting plate 312 is disposed at one side of the chair leg 21 facing toward the seat body 1.

Figure 7:
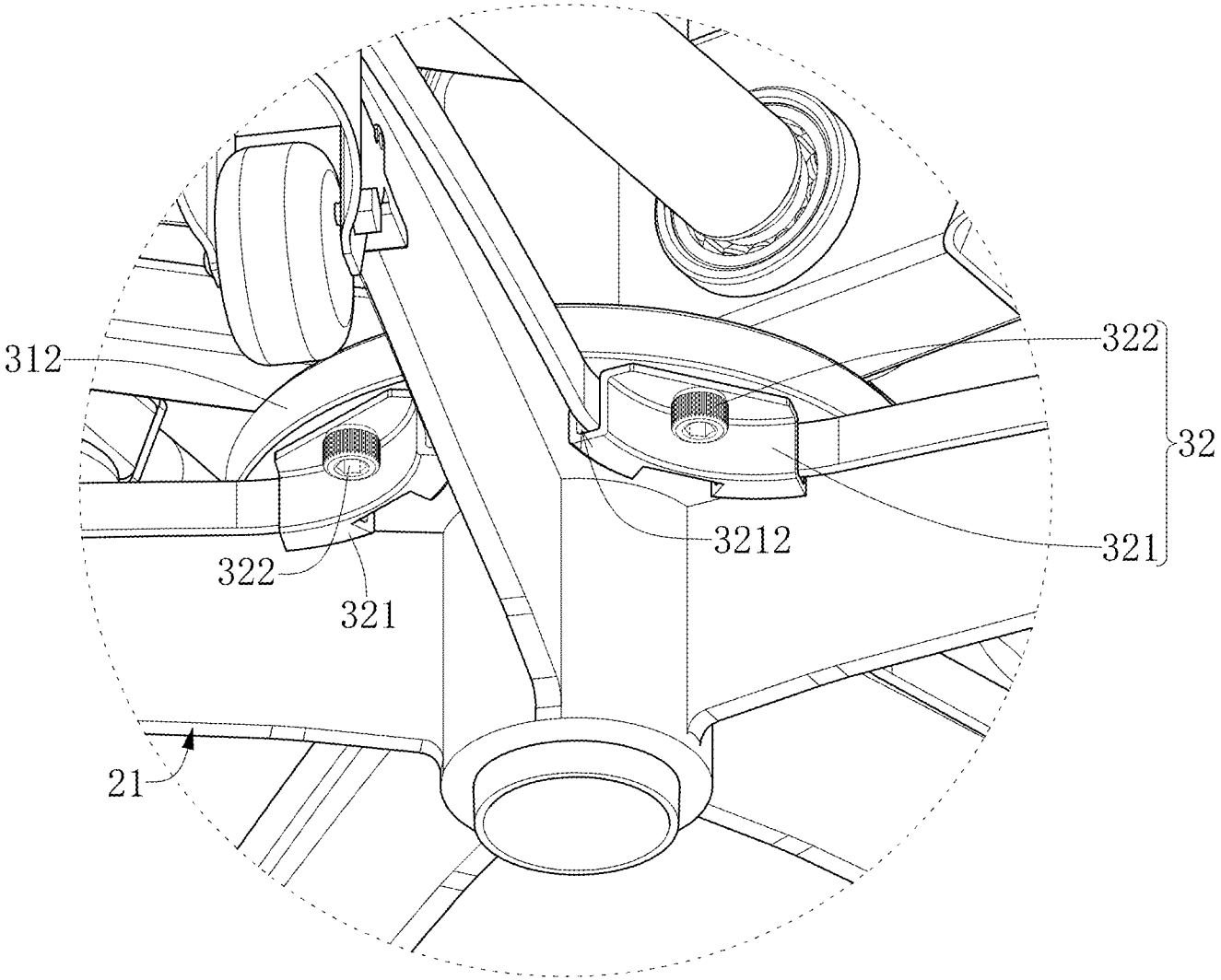
FIG. 7 is a schematic partially enlarged view of area VII of FIG. 2.
Figure 8:
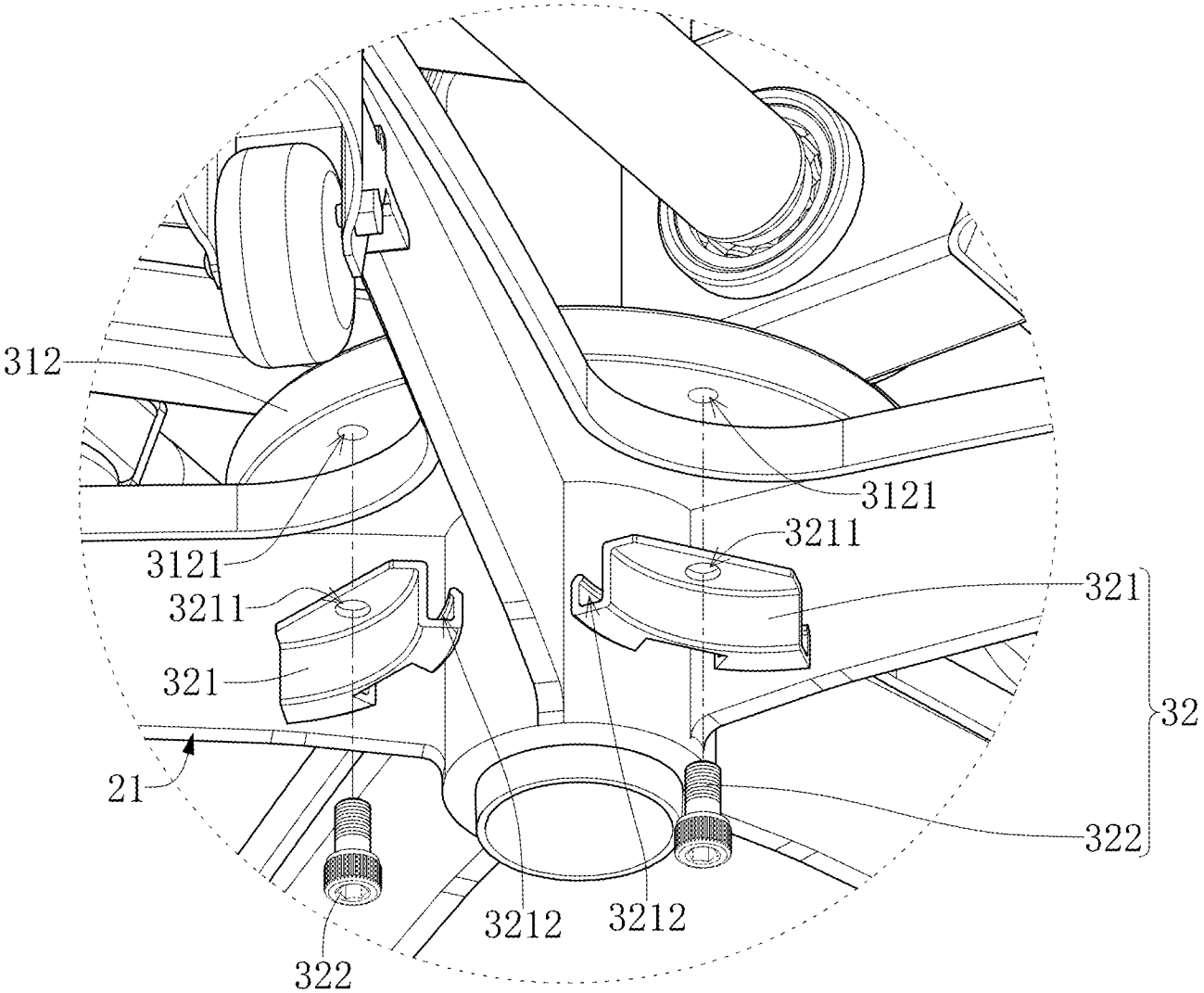
FIG. 8 is a schematic partially exploded view of FIG. 7.

As shown in FIG. 2, FIG. 4, FIG. 7, and FIG. 8, FIG. 7 is a schematic partially enlarged view of area VII of FIG. 2, and FIG. 8 is a schematic partially exploded view of FIG. 7. Each of the fixing members 32 includes an auxiliary fixing component 321 and a locking component 322. Multiple ones of the auxiliary fixing component 321 and multiple ones of the locking component 322 included in each of the fixing members 32 is not limited to a single one. The fixing seat 31 is disposed at one side of the chair leg 21 connected to the lifting component 22. Multiple ones of the auxiliary fixing component 321 are disposed at another side of the chair leg 21 opposite to the seat body 1, and multiple ones of the locking component 322 are configured to fix the multiple ones of the auxiliary fixing component 321 and the fixing seat 31 to each other. Accordingly, the fixing seat 31 and the multiple ones of the auxiliary fixing component 321 are jointly fixed to the chair leg 21.

More specifically, the connecting plate 312 can have five threaded holes 3121, each auxiliary fixing component 321 includes a through hole 3211, the auxiliary fixing component 321 includes an engaging structure 3212, such that the auxiliary fixing component 321 can be fixed to the chair leg 21 through the engaging structure 3212. Each locking component 322 can be, for example, a screw, and can pass through the through hole 3211 of the auxiliary fixing component 321 to fix to one of the threaded holes 3121 of the connecting plate 312. Therefore, the connecting plate 312 can be fixed to the side of the chair leg 21 facing toward the seat body 1, and the exercise kit 3 is fixed and disposed between the seat body 1 and the chair leg 21.

In the drawings of the present embodiment, the chair leg 21 includes the five claws, the exercise kit 3 includes the five fixing members 32, and the connecting plate 312 includes the five threaded holes 3121, but a quantity of the fixing members 32 included in the exercise kit 3 is not limited to five, and can be adjusted according to the quantity of the claws.

As described above, the exercise kit 3 is fixed to the side of the chair leg 21 facing toward the seat body 1 through the fixing seat 31 and the five fixing members 32. Therefore, in practical applications, the exercise kit 3 can be disposed under various types of sliding chairs (e.g., office chairs) by simply modifying the appearance of the fixing seat 31 and the fixing members 32. In other words, when the exercise kit 3 of the multi-functional chair 100 of the present embodiment is disassembled, the seat body 1 and the chair leg module 2 can be used as a general movable chair (e.g., an office chair). According to this design, when the exercise kit 3 needs to be repaired, the relevant maintenance personnel only needs to disassemble the exercise kit 3 from the chair leg module 2, so as to allow the user to continue using the movable chair.

As shown in FIG. 4 to FIG. 6, the supporting structure 33 is disposed at one side of the hollow sleeve 311. The supporting structure 33 can include a base 331, an extension arm 332, and a fixed arm 333. Two ends of the base 331 are respectively connected to the hollow sleeve 311 and the extension arm 332. The extension arm 332 can be an inclined structure formed by extending the base 331 in a direction away from the connecting plate 312. One end of the extension arm 332 opposite to another end of the extension arm 332 connected to the base 331 is connected to a middle position of the fixed arm 333. The fixed arm 333 can be, for example, an arc-shaped structure, and the two hook components 37 can be respectively disposed at two ends of the fixed arm 333. Each of the hook components 37 is configured to allow one end of an exercise resistance band to be attached thereto by the user.

One end of one of the damping rods 35 and one end of one of the springs 34 are fixed to the fixed arm 333, and can be disposed adjacent to one end of the fixed arm 333, while another end of the one of the damping rods 35 and another end of the one of the springs 34 are connected to one of the pedal modules 36. One end of another one of the damping rods 35 and one end of another one of the springs 34 are fixed to the fixed arm 333, and can be disposed adjacent to another end of the fixed arm 333, while another end of the another one of the damping rods 35 and another end of the another one of the springs 34 are connected to another one of the pedal modules 36. The two springs 34 can be respectively sleeved on the outer sides of the two damping rods 35.

Figure 9:
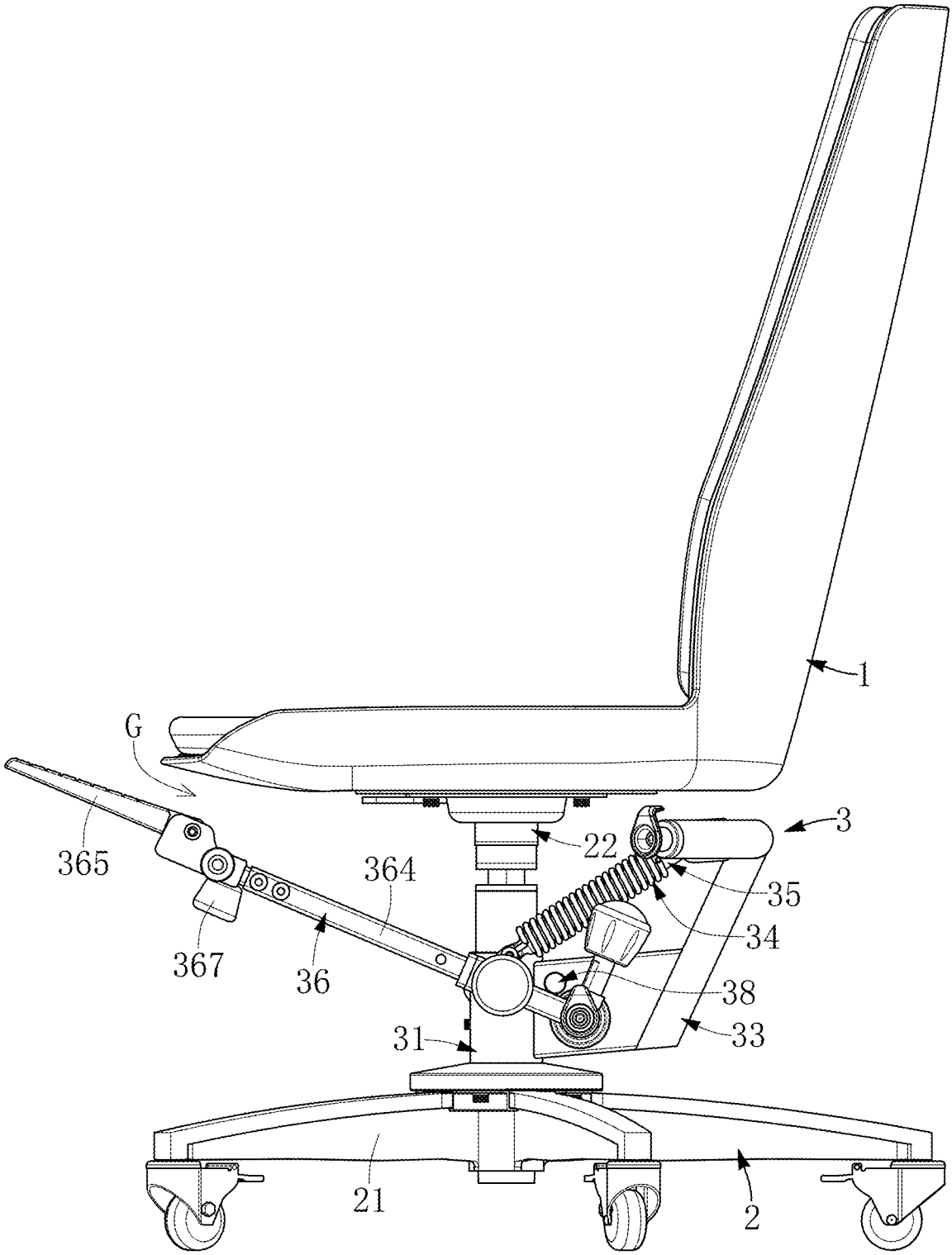
FIG. 9 is a side view of the multi-functional chair according to the embodiment of the present disclosure.
Figure 10:
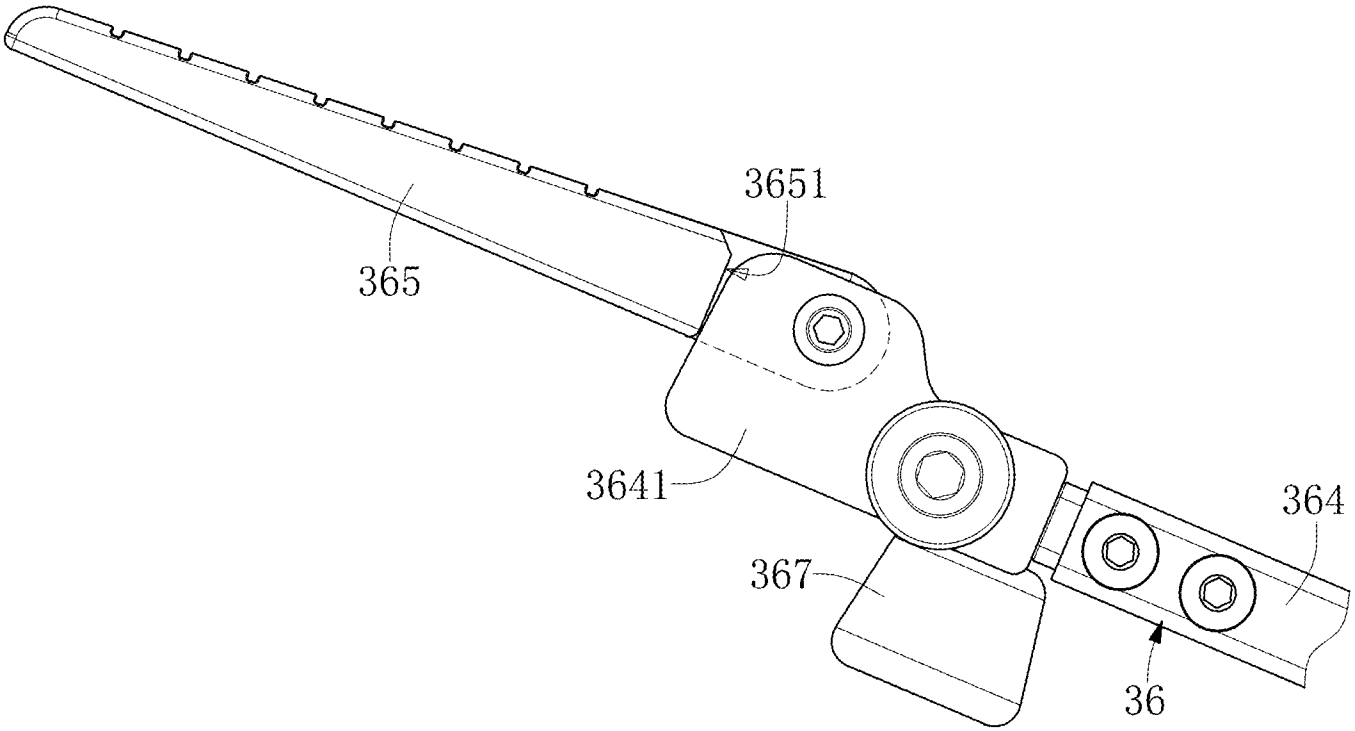
FIG. 10 is a schematic partially enlarged view of a pedal module of the multi-functional chair according to the embodiment of the present disclosure.

As shown in FIG. 5, FIG. 6, FIG. 9, and FIG. 10, FIG. 9 is a side view of the multi-functional chair according to the embodiment of the present disclosure, and FIG. 10 is a schematic partially enlarged view of a pedal module of the multi-functional chair according to the embodiment of the present disclosure.

Each of the pedal modules 36 includes one of two rotating components, one of two connecting arms 364, one of two pedals 365 and one of two adjustment components 368. For the convenience of subsequent embodiment descriptions, the two rotating components respectively included in the two pedal modules 36 are respectively defined as a first rotating component 362 and a second rotating component 363. In the following description, if the description is in terms of the rotating components, then the description is applicable to both the first rotating component 362 and the second rotating component 363. If the description refers specifically to the first rotating component 362 or the second rotating component 363, then the description is only applicable to the first rotating component 362 or the second rotating component 363.

The rotating components are rotatably connected to the base 331 of the supporting structure 33. One end of each of the rotating components can be provided with one of the hook components 37. In practical applications, the base 331 can be provided with a plurality of ball bearings, and the one end of each of the rotating components is rotatably connected to the base 331 through one of the ball bearings.

One end of each of the connecting arms 364 is fixed to one of the rotating components, and each of the two pedals 365 is rotatably connected to another end of each of the connecting arms 364. Therefore, each of the pedals 365 is provided for the user sitting on the seat body 1 to step on the pedals 365.

As shown in FIG. 9 and FIG. 10, in practice, one end of each of the connecting arms 364 connected to the pedals 365 can be provided with a limiting component 3641, and each of the pedals 365 has a limiting structure 3651 (e.g., against top surface) corresponding to the limiting component 3641. The limiting component 3641 is used to restrict the rotation of the pedals 365 toward a direction of the chair leg 21, such that the pedals 365 and the connecting arms 364 can be substantially parallel to each other. With this design, when the user's feet are placed on the pedals 365, the pedals 365 do not rotate toward the direction of the chair leg 21, such that the user's feet are not flipped downwards. In other words, when the user steps on the pedals 365, the limiting structure 3651 of each of the pedals 365 is abutted against the limiting component 3641. Therefore, the pedals 365 do not rotate toward the direction of the chair leg 21.

Figure 11:
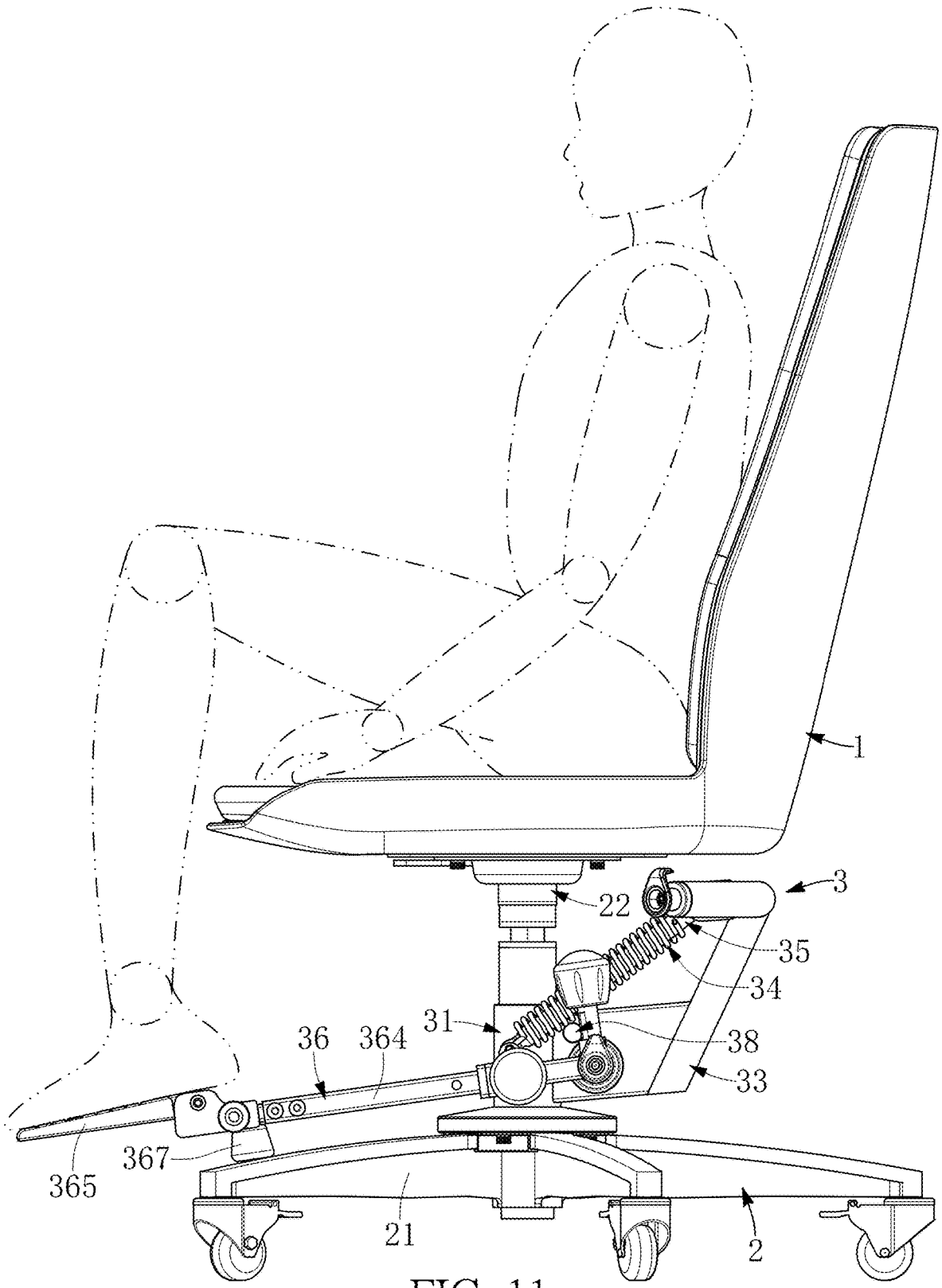
FIG. 11 is a side view of a pedal of the multi-functional chair being stepped on by a user according to the embodiment of the present disclosure.

As shown in FIG. 9, FIG. 10 and FIG. 11, when the user is sitting on the seat body 1, the user's feet can step on the two pedals 365 to rotate the two connecting arms 364 toward a direction away from the seat body 1. In this process, the two springs 34 are stretched, and an elastic recovery force generated by stretching of the two springs 34 provides resistance for the user to step thereon, so as to achieve the exercise effect for the user.

It is worth mentioning that, under normal circumstances, the two pedal modules 36 can move independently of each other, and the user can use the two pedal modules 36 to train each of the left foot or the right foot according to practical requirements. In other words, when the user's feet are placed on the two pedal modules 36, the user can train by treading. In different embodiments of the present disclosure, the two pedal modules 36 can also move simultaneously (details are described in subsequent embodiments).

As shown in FIG. 5, FIG. 6, FIG. 9, and FIG. 10, it should be noted that, in a better application, each of the connecting arms 364 can be provided with one of the adjustment components 368. Each of the adjustment components 368 includes one of two sliders 3681 and one of two spring pull pins 3682 (spring latch). Each of the sliders 3681 is slidably disposed at one of the connecting arms 364, and each of the spring pull pins 3682 is disposed on one of the sliders 3681. One end of each of the springs 34 and one end of each of the damping rods 35 are respectively fixed to one of the sliders 3681. The user can operate the spring pull pins 3682 to move the spring pull pins 3682 through the sliders 3681 to different positions on the connecting arms 364, and a bolt of each of the spring pull pins 3682 can be inserted into different through holes 3642 of the connecting arms 364, thereby changing a position of the one end of the springs 34 connected to one of the connecting arms 364. Therefore, when the user steps on the pedals 365, the user can experience varying levels of resistance provided by the spring 34.

It is worth mentioning that, in practice, one side of each of the pedals 365 facing toward the chair leg 21 can be further provided with an elastic abutting component 367. When each of the pedals 365 is stepped on by the user and rotates towards the direction of the chair leg 21, the elastic abutting component 367 is used to abut against the chair leg 21, thereby preventing the pedal modules 36 from causing damage to the chair leg 21.

As shown in FIG. 11, when the user steps the pedals 365 downward to its farthest position from the seat body 1 and then removes their feet from the pedals 365, the elastic recovery force of the two springs 34 drives the connecting arms 364 to move in a direction towards the seat body 1. During the process of the connecting arms 364 moving toward the seat body 1, each of the damping rods 35 connected to one of the connecting arms 364 provides resistance. Accordingly, the two pedal modules 36 can slowly move in the direction towards the seat body 1.

As described above, through the design of the damping rods 35, when the two pedal modules 36 move in the direction towards the seat body 1, an issue of the user's feet being caught by the two pedal modules 36 can be effectively prevented.

As shown in FIG. 3, FIG. 5, FIG. 6, and FIG. 9, in practice, two sides of the base 331 of the supporting structure 33 respectively have two block components 38. Each of the block components 38 is configured to abut against one of the connecting arms 364, such that a gap G is formed between the pedals 365 and the seat body 1. In other words, when the two pedal modules 36 are not being stepped on by the user, each of the connecting arms 364 abuts against the adjacent one of the block components 38, and each of the pedals 365 does not abut against the seat body 1, thereby preventing the user's feet from being caught.

In other words, when the user no longer steps on the two pedal modules 36, the two pedal modules 36 are driven by the two springs 34 and the two damping rods 35, and slowly move toward the direction of the seat body 1 until the two connecting arms 364 abut against the two block components 38 adjacent thereto. When the two connecting arms 364 abut against the two block components 38, the gap G is formed between the two pedals 365 and the seat body 1.

As shown in FIG. 9 to FIG. 13, FIG. 12 is a side view of the pedal of the multi-functional chair located in a retracted position according to the embodiment of the present disclosure. Each of the connecting arms 364 adjacent to the pedals 365 can also be provided with an auxiliary handle 39. The auxiliary handle 39 is configured to provide for the user to grip, such that the user can grip the auxiliary handle 39 to rotate the connecting arms 364 toward a direction away from the seat body 1.

Figure 12:
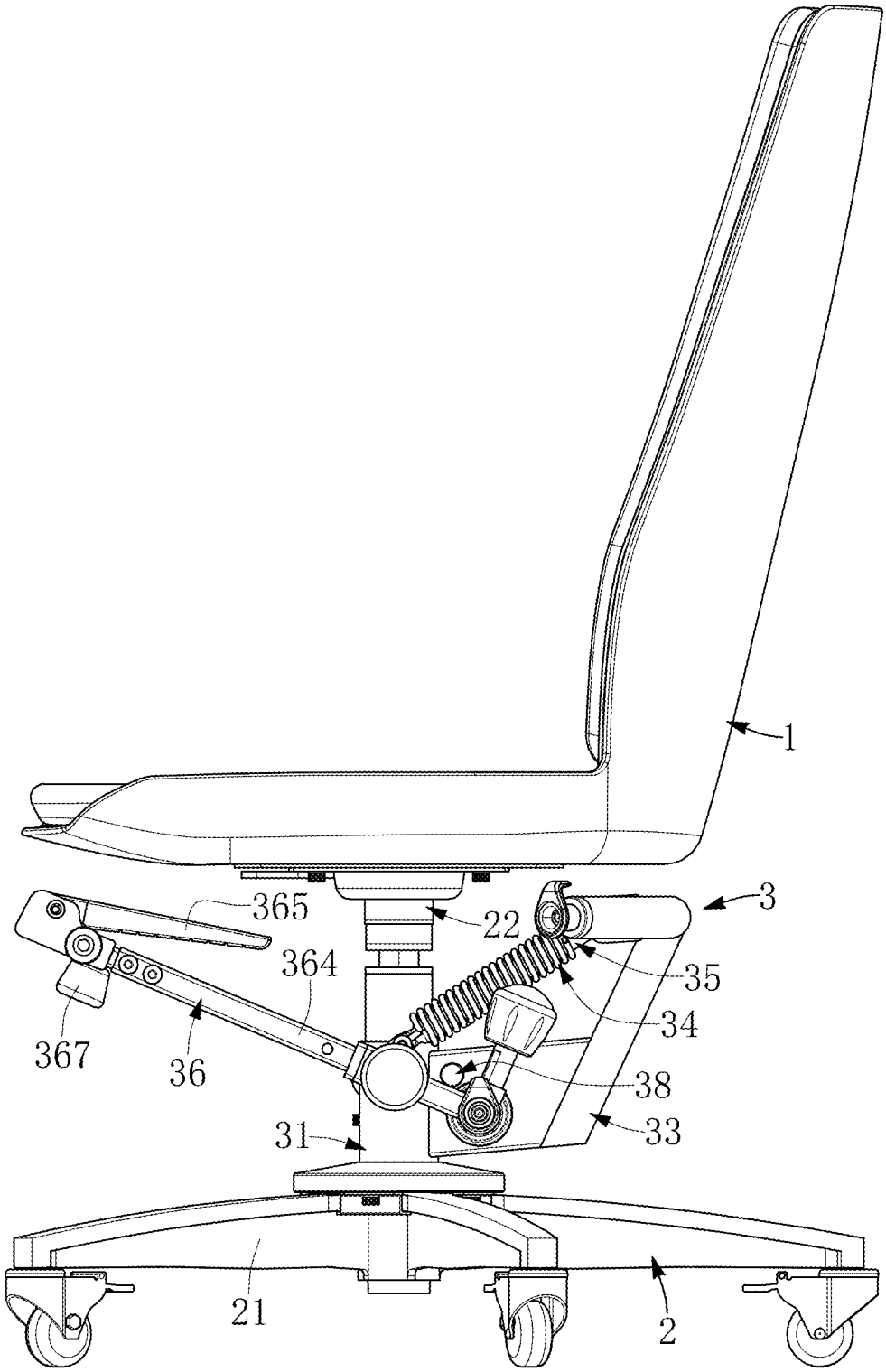
FIG. 12 is a side view of the pedal of the multi-functional chair located in a retracted position according to the embodiment of the present disclosure.
Figure 13:
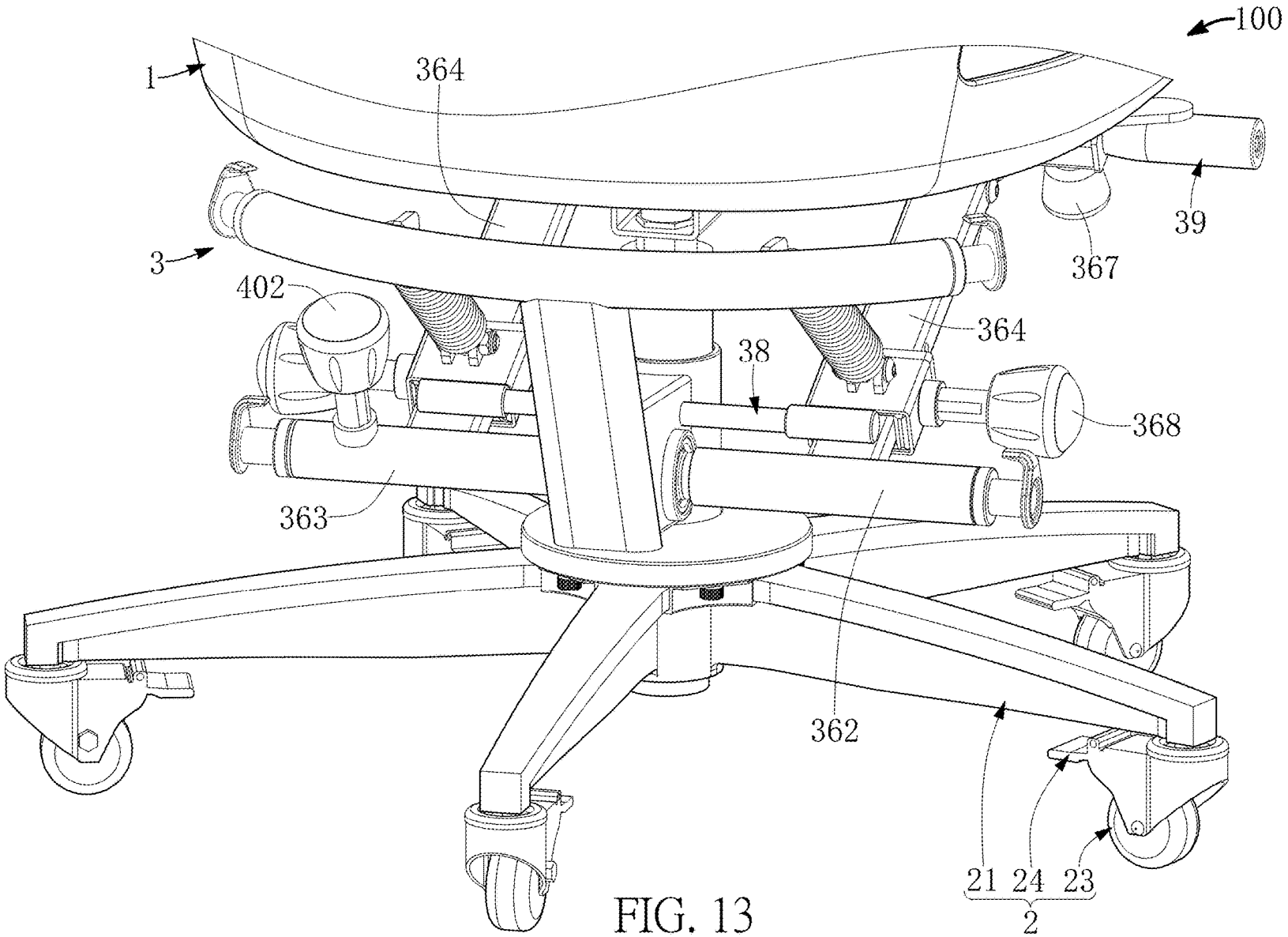
FIG. 13 is a rear side view of the multi-functional chair according to the embodiment of the present disclosure.

In practice, each of the pedals 365 is rotatably connected to one of the connecting arms 364, and each of the pedals 365 is operable to rotate relative to the connecting arms 364 between a moving position (as shown in FIG. 9) and a retracted position (as shown in FIG. 12). When the pedals 365 are located at the moving position, the pedals 365 is configured to be stepped on by the user sitting on the seat body 1.

When the user no longer steps on the pedals 365, the two pedals 365 are returned to the moving position as shown in FIG. 9. At this time, the user can grip the auxiliary handle 39 to rotate the connecting arms 364 toward the direction away from the seat body 1 to increase the space of the gap G between the pedals 365 and the seat body 1. Then, the user can pull the pedals 365 to rotate toward the supporting structure 33, thereby switching the pedals 365 from the moving position to the retracted position (as shown in FIG. 12). When the pedals 365 are located at the retracted position, the pedals 365 are located under the seat body 1, and the pedals 365 do not protrude from a front edge of the seat body 1. Accordingly, the pedals 365 do not affect the normal use of the chair.

As described above, through the design of the outer sides of each of the connecting arms 364 being provided with the auxiliary handle 39 in combination with the design of the block components 38, the user can switch the pedals 365 from the moving position to the retracted position without the risk of pinching their hands.

It is worth mentioning that, the exercise kit 3 is fixed to the chair leg 21. Therefore, when the user operates the lifting component 22 to lift the seat body 1 in a direction away from the chair leg 21, the exercise kit 3 does not move with the seat body 1. In other words, the seat body 1 is also moved away from the exercise kit 3 at the same time. Accordingly, when the user switches the pedals 365 from the moving position to the retracted position, the user can first operate the lifting component 22 to move the seat body 1 in a direction away from the two pedal modules 36, and operate the pedals 365 to rotate the pedals 365 inward to switch the pedals 365 to the retracted position. In this way, the user can rotate the pedals 365 to the retracted position more conveniently.

Figure 14:
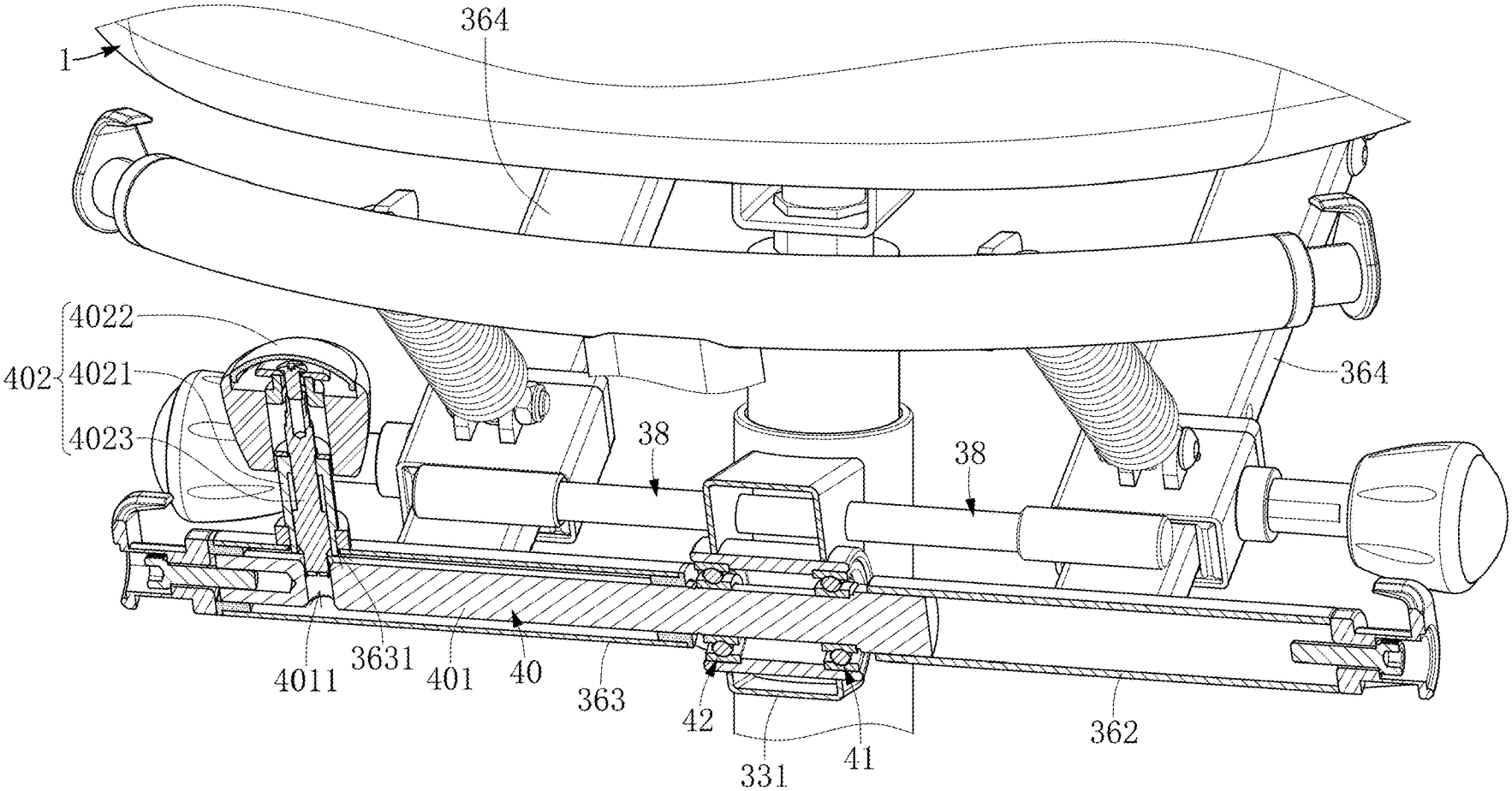
FIG. 14 is a schematic partially cross-sectional view of a synchronous member, a first rotating component, and a second rotating component of the multi-functional chair according to the embodiment of the present disclosure.
Figure 15:
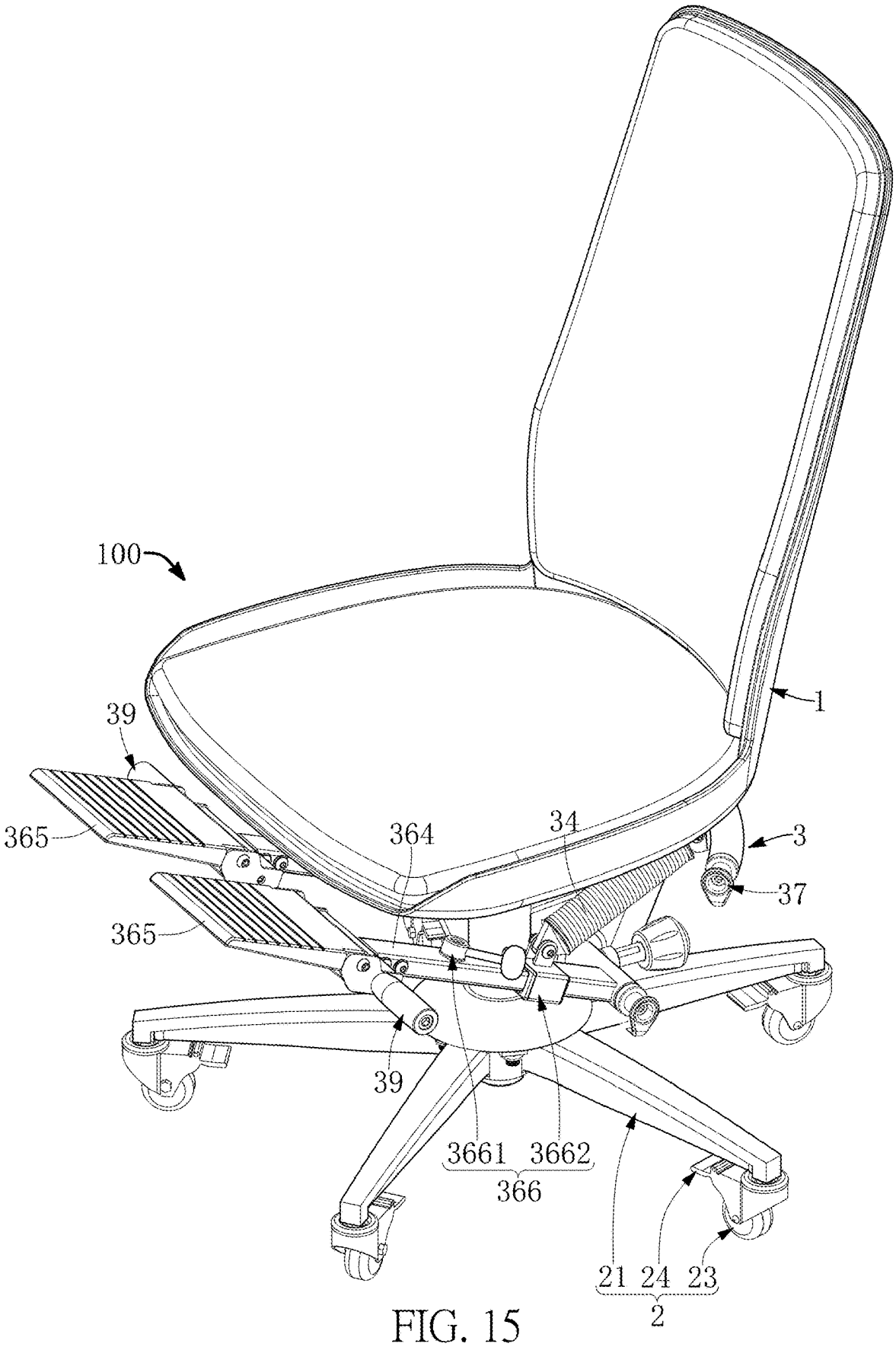
FIG. 15 is a schematic view of the multi-functional chair according to a second embodiment of the present disclosure.

As shown in FIG. 5, FIG. 6, FIG. 13, and FIG. 14, FIG. 13 is a rear side view of the multi-functional chair according to the embodiment of the present disclosure, and FIG. 14 is a schematic partially cross-sectional view of a synchronous member, a first rotating component, and a second rotating component of the multi-functional chair according to the embodiment of the present disclosure.

In practice, the first rotating component 362 and the second rotating component 363 are respectively disposed at the two sides of the supporting structure 33. The first rotating component 362 and the second rotating component 363 are located on an axis, such that the first rotating component 362 and the second rotating component 363 can rotate respectively with the same axis as the center relative to the supporting structure 33. The first rotating component 362 and the second rotating component 363 can each be a hollow tube.

The exercise kit 3 further includes a synchronous member 40. The synchronous member 40 includes a linkage rod 401 and a locking component 402. One end of the linkage rod 401 is fixed to the first rotating component 362, and the linkage rod 401 is also connected to a first ball bearing 41 and a second ball bearing 42 disposed in the base 331, such that the linkage rod 401 can rotate relative to the base 331 along with the first rotating component 362. The first ball bearing 41 and the second ball bearing 42 are respectively disposed at two sides of the base 331. One end of the first rotating component 362 and one end of the second rotating component 363 are respectively connected to the first ball bearing 41 and the second ball bearing 42, such that the first rotating component 362 and the second rotating component 363 can rotate relative to the base 331 through the first ball bearing 41 and the second ball bearing 42.

Another end of the linkage rod 401 is disposed in the second rotating component 363. When the synchronous member 40 does not connect the linkage rod 401 to the second rotating component 363, the linkage rod 401 can rotate with the first rotating component 362 in the second rotating component 363.

The second rotating component 363 includes a through hole 3631. The linkage rod 401 includes a threaded hole 4011. The locking component 402 includes a main body 4021, a manipulating portion 4022, and a locking structure 4023. The main body 4021 is fixed around the through hole 3631 of the second rotating component 363, the manipulating portion 4022 is rotatably connected to the main body 4021, the manipulating portion 4022 is fixed to the locking structure 4023, and one end of the locking structure 4023 has screw threads.

The user can rotate the manipulating portion 4022 to extend one end of the locking structure 4023 through the through hole 3631 of the second rotating component 363 into the second rotating component 363, and the locking structure 4023 is locked with the threaded hole 4011 of the linkage rod 401. In contrast, the user can rotate the manipulating portion 4022 to move the end of the locking structure 4023 away from the threaded hole 4011 of linkage rod 401.

When the locking structure 4023 is locked with the threaded hole 4011 of linkage rod 401, the second rotating component 363, the linkage rod 401, and the first rotating component 362 can rotate synchronously. In other words, the user can step on the two pedals 365 to synchronously rotate the two pedal modules 36 in the direction away from the seat body 1. Furthermore, when the locking structure 4023 is locked with the threaded hole 4011 of linkage rod 401, the user can also step on one of the pedals 365 with a single foot to cause the two pedal modules 36 to rotate synchronously. In this situation, a single foot of the user should apply relatively large force, such that the two pedal modules 36 can be synchronously rotated in the direction away from the seat body 1. This allows the user to perform resistance training with one foot.

Second Embodiment

Figure 16:
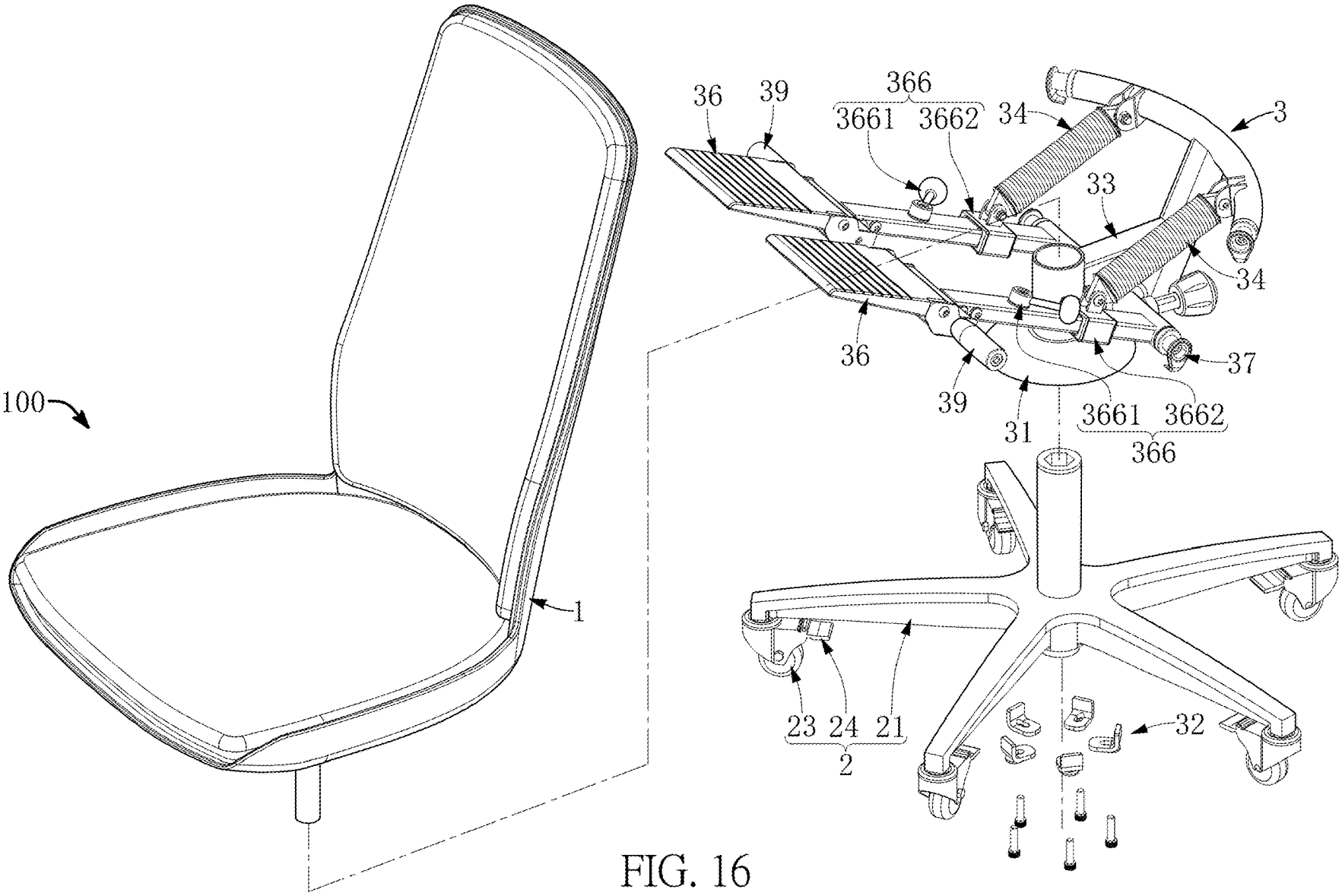
FIG. 16 is a schematic exploded view of the multi-functional chair according to the second embodiment of the present disclosure.
Figure 17:
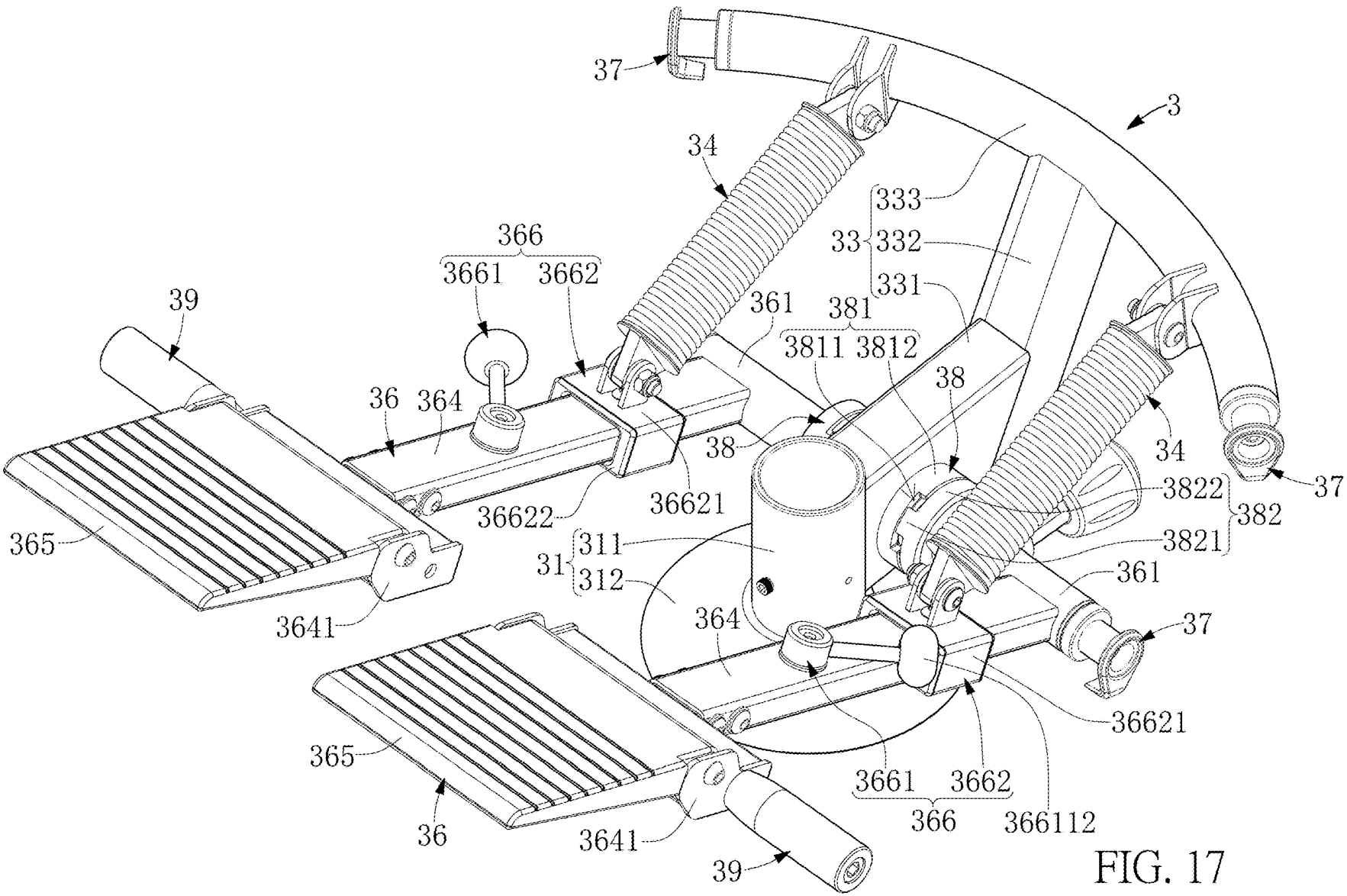
FIG. 17 is a schematic view showing a slider of the exercise kit located at a first slider position of the multi-functional chair according to the second embodiment of the present disclosure.
Figure 18:
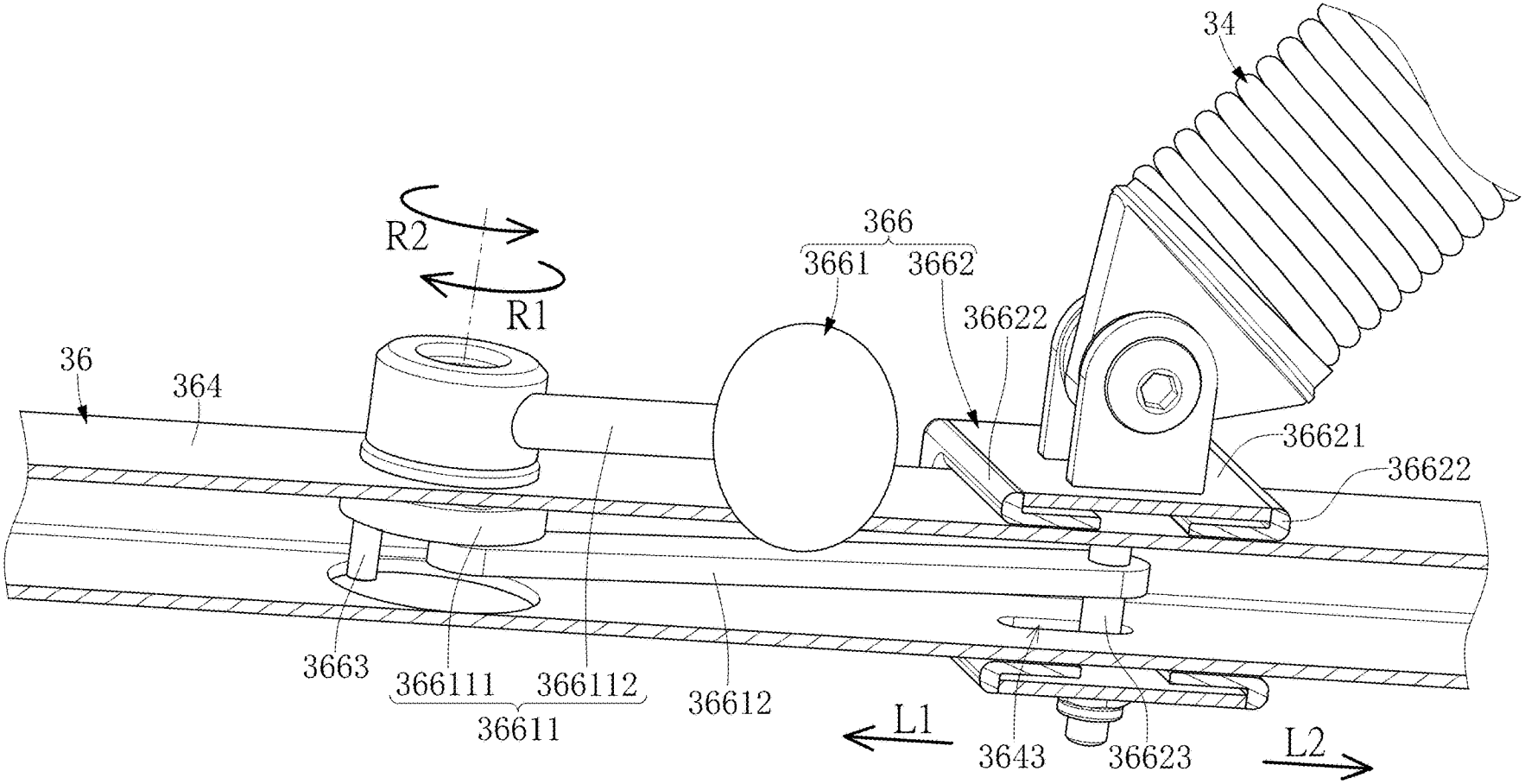
FIG. 18 is a schematic partially cross-sectional view showing the slider of the exercise kit located at the first slider position of the multi-functional chair according to the second embodiment of the present disclosure.
Figure 19:
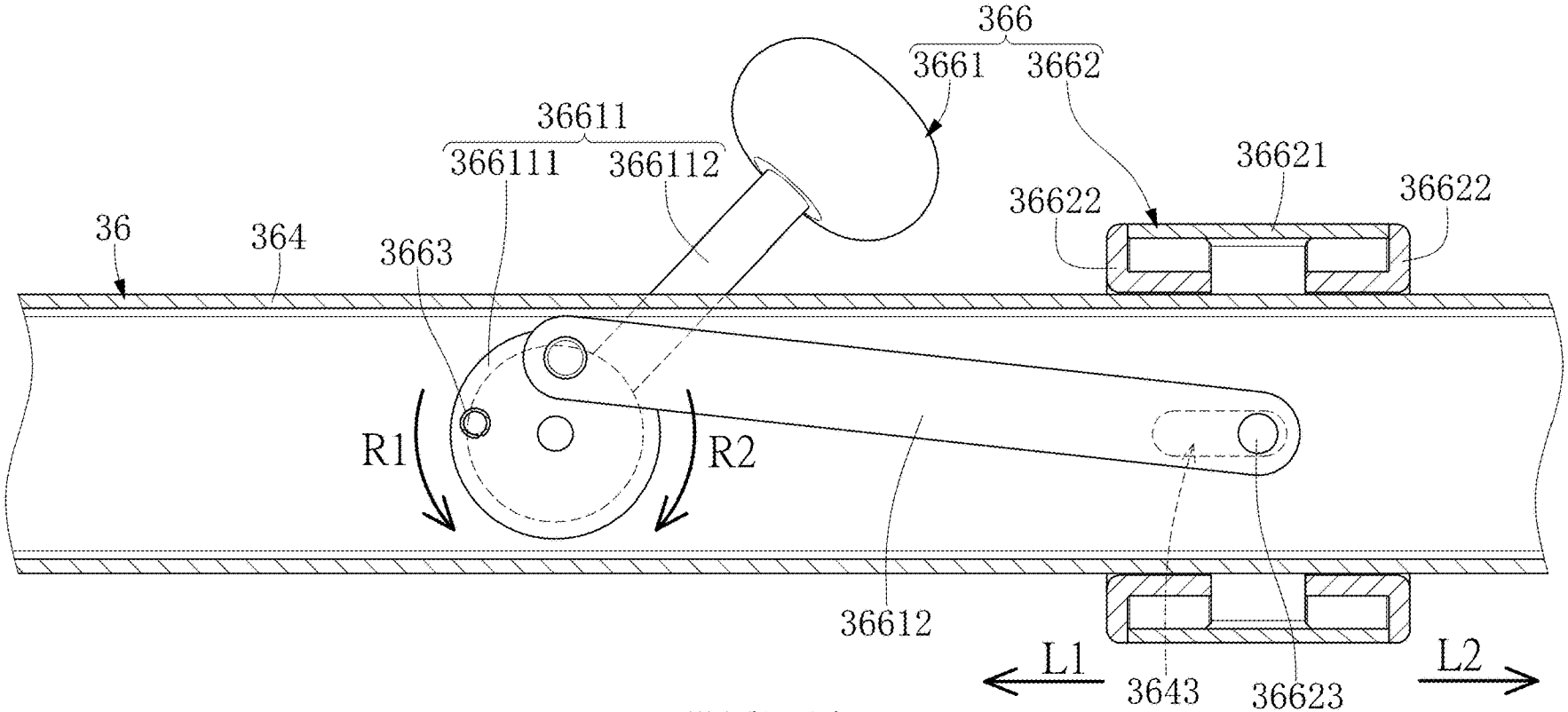
FIG. 19 is a schematic partially bottom and cross-sectional view showing the slider of the exercise kit located at the first slider position of the multi-functional chair according to the second embodiment of the present disclosure.
Figure 20:
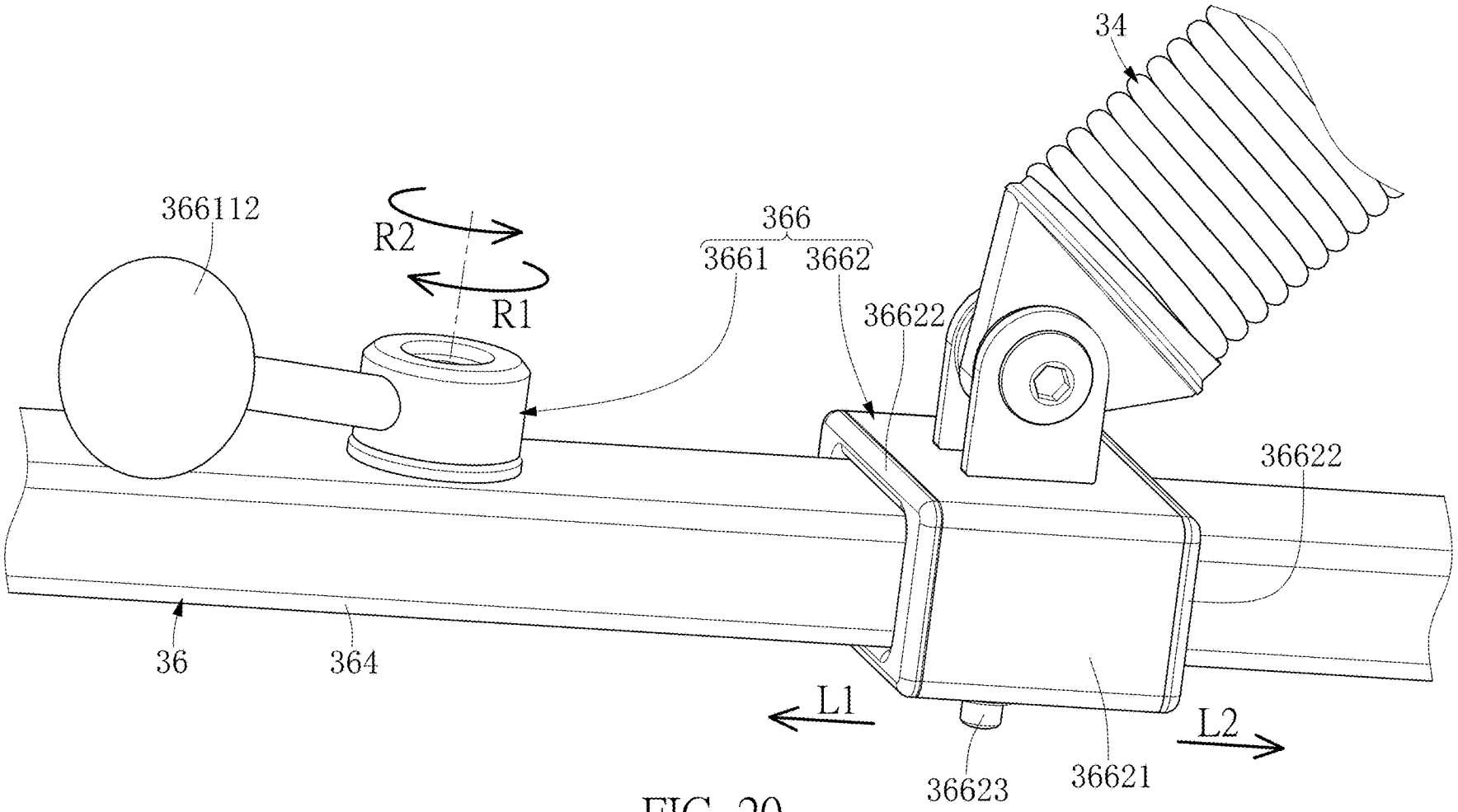
FIG. 20 is a schematic partially view showing the slider of the exercise kit located at a second slider position of the multi-functional chair according to the second embodiment of the present disclosure.
Figure 21:
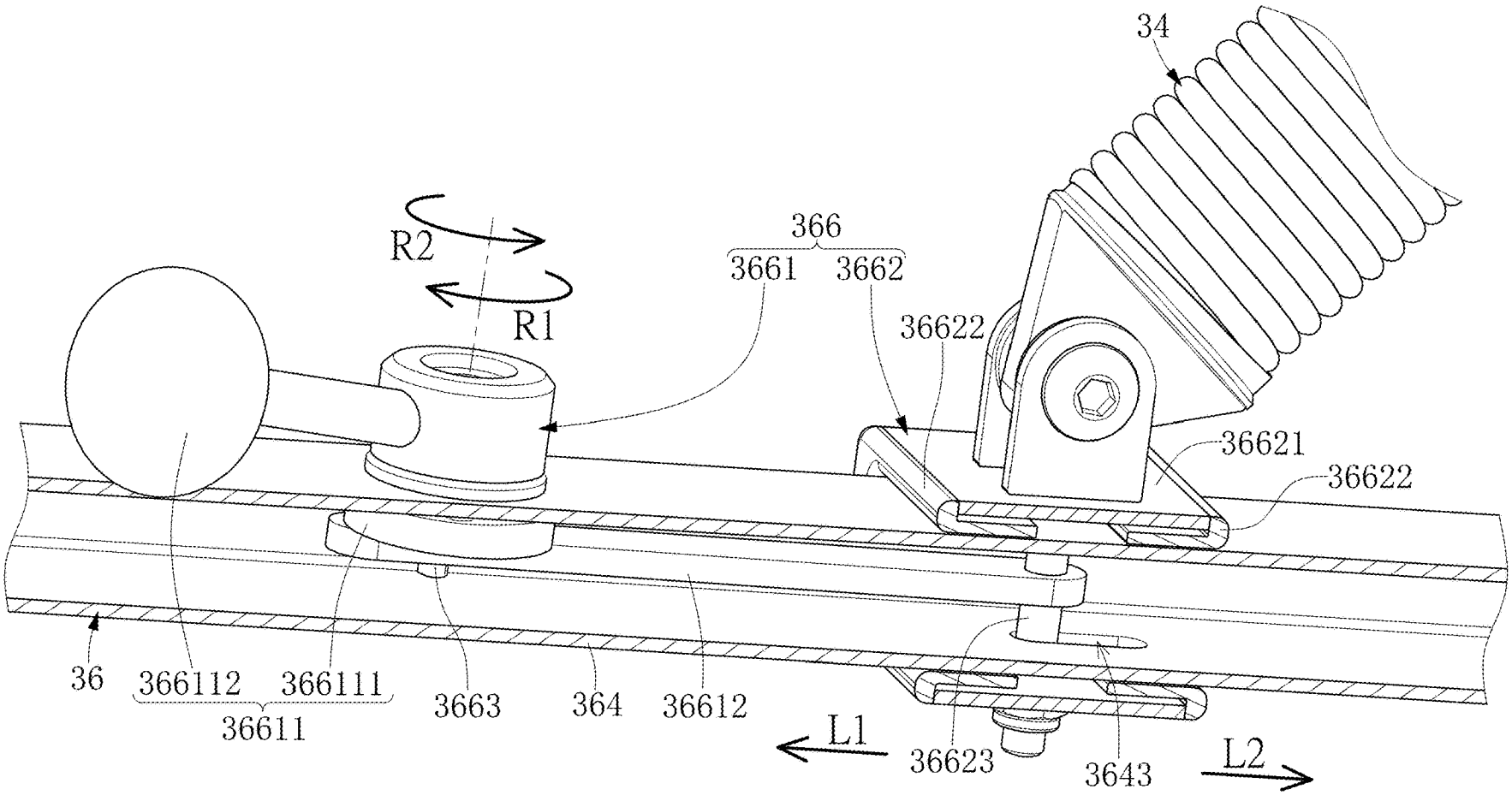
FIG. 21 is a schematic partially cross-sectional view showing the slider of the exercise kit located at the second slider position of the multi-functional chair according to the second embodiment of the present disclosure.
Figure 22:
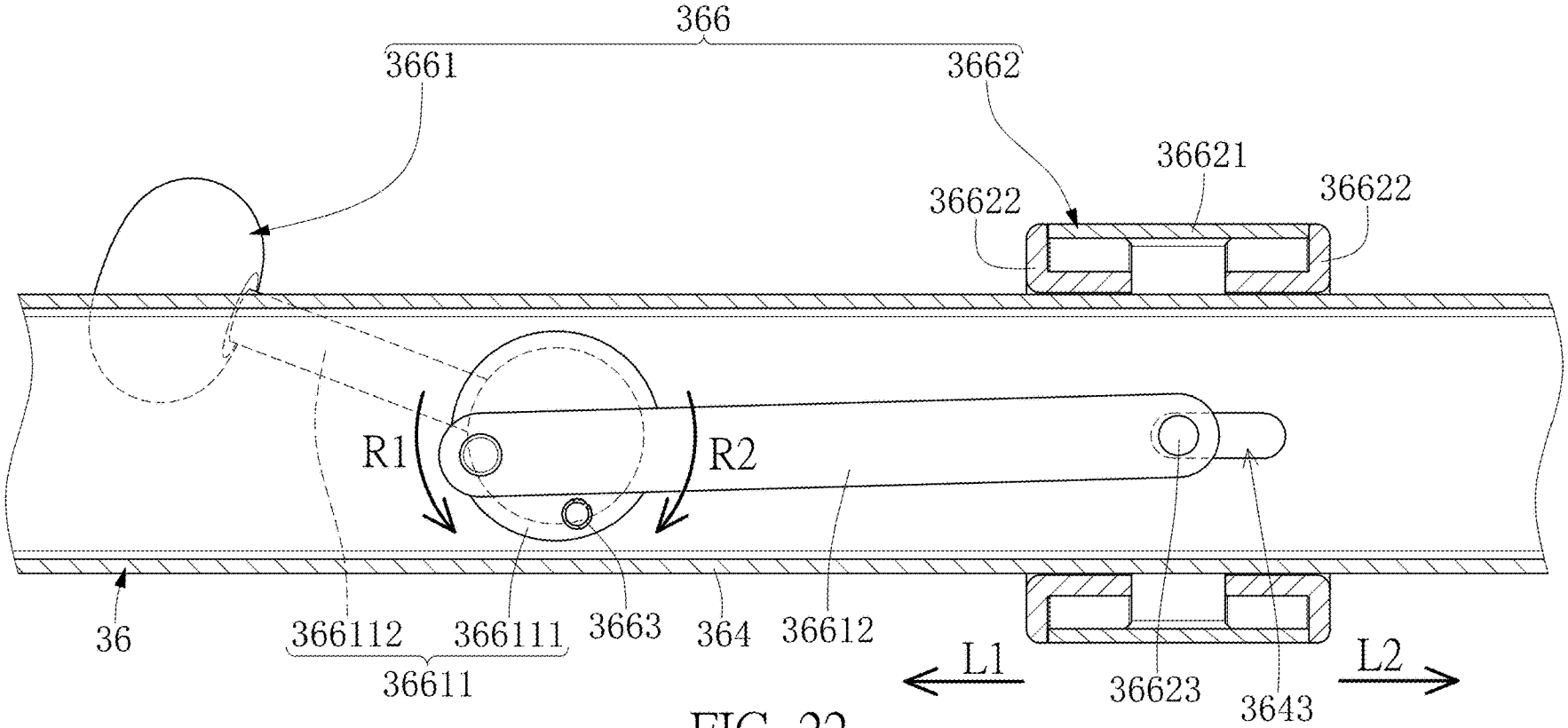
FIG. 22 is a schematic partially bottom and cross-sectional view showing the slider of the exercise kit located at the second slider position of the multi-functional chair according to the second embodiment of the present disclosure.

As shown in FIG. 15 to FIG. 22, FIG. 15 is a schematic view of the multi-functional chair according to a second embodiment of the present disclosure; FIG. 16 is a schematic exploded view of the multi-functional chair according to the second embodiment of the present disclosure; FIG. 17 is a schematic view showing a slider of the exercise kit located at a first slider position of the multi-functional chair according to the second embodiment of the present disclosure; FIG. 18 is a schematic partially cross-sectional view showing the slider of the exercise kit located at the first slider position of the multi-functional chair according to the second embodiment of the present disclosure; FIG. 19 is a schematic partially bottom and cross-sectional view showing the slider of the exercise kit located at the first slider position of the multi-functional chair according to the second embodiment of the present disclosure; FIG. 20 is a schematic partially view showing the slider of the exercise kit located at a second slider position of the multi-functional chair according to the second embodiment of the present disclosure; FIG. 21 is a schematic partially cross-sectional view showing the slider of the exercise kit located at the second slider position of the multi-functional chair according to the second embodiment of the present disclosure; FIG. 22 is a schematic partially bottom and cross-sectional view showing the slider of the exercise kit located at the second slider position of the multi-functional chair according to the second embodiment of the present disclosure.

The difference between this embodiment and the previous embodiment is that each of the two pedal modules 36 includes one of two rotating components 361, one of two connecting arms 364, one of two pedals 365, and one of two adjust modules 366. The rotating components 361 are rotatably connected to the base 331 of the supporting structure 33. One end of each of the rotating components 361 can further be provided with one of two hook components 37. In practice, the base 331 can be provided with a ball bearing, and one end of each of the rotating components 361 can be rotatably connected to the base 331 through the ball bearing.

Each of the adjust modules 366 includes a manipulating component 3661, a sliding component 3662, a first limiting structure 3643, and a second limiting structure 3663. The manipulating component 3661 is rotatably disposed on one of the connecting arms 364. The manipulating component 3661 includes a linkage rotating component 36611 and a linkage rod 36612. The linkage rotating component 36611 includes a body 366111 and a grip portion 366112. The body 366111 is, for example, a disk-shaped. One of the connecting arms 364 is, for example, a hollow structure, and the body 366111 and the linkage rod 36612 can be disposed in one of the connecting arms 364. The body 366111 of the linkage rotating component 36611 is rotatably disposed at one of the connecting arms 364, and one end of the linkage rod 36612 is pivotally connected to the linkage rotating component 36611. The grip portion 366112 is connected to the body 366111, and the grip portion 366112 is disposed at an outside of one of the connecting arms 364, such that the grip portion 366112 is operable by user.

The sliding component 3662 includes a slider 36621 and two pipe plugs 36622. The slider 3662 is, for example, a hollow structure, the slider 36621 is sleeved on one of the connecting arms 364, and the slider 36621 can slide relative to one of the connecting arms 364. The two pipe plugs 36622 are respectively disposed at two ends of the slider 36621, a part of each of the two pipe plugs 36622 is used to fill a gap between the slider 36621 and one of the connecting arms 364. The two pipe plugs 36622 are used to increase the friction between the slider 36621 and one of the connecting arms 364, and the two pipe plugs 36622 can be used to assist in limiting a range of movement of the slider 36621 relative to one of the connecting arms 364. When the slider 36621 is not acted upon by an external force, the slider 36621 is not moved relative to one of the connecting arms 364 due to the arrangement of the two pipe plugs 36622. Conversely, when the slider 36621 is acted upon by the externa force, the slider 36621 and the two pipe plugs 36622 are moved together relative to one of the connecting arms 364.

The slider 36621 is fixed to one end of one of the two springs 34, and the slider 36621 is connected to the another end of the linkage rod 36612. When one of the connecting arms 364 is the hollow structure, the slider 36621 is fixed to another end of the linkage rod 36612 through the connector 36623. The connector 36623 includes, for example, a screw rod and a nut.

The first limiting structure 3643 is disposed on one of the connecting arms 364 and adjacent to the slider 36621. The first limiting structure 3643 is, for example, an elongated through hole, the elongated through hole is form from one of the connecting arms 364, a part of the connector 36623 is through the elongated through hole. When the connector 36623 is against to one end of the elongated through hole, the connector 36623 is abutting against a side wall formed the elongated through hole, such that the movement range of the slider 36621 connected to the connector 36623 is be limited. The first limiting structure 3643 is mainly used to limit a movement range of the linkage rod 36612 relative to one of the connecting arms 364, such that a length of the elongated through hole can be adjusted according to practical requirements.

The second limiting structure 3663 is fixed and disposed on the body 366111 of the linkage rotating component 36611, the second limiting structure 3663 and the linkage rod 36612 are fixed to a same side of the body 36611 of the linkage rotating component 36611, and the second limiting structure 3663 is, for example, a protruding structure (e.g., protruding pillar). The second limiting structure 3663 is mainly used to limit a rotation range of the linkage rod 36612 relative to a rotation range of one of the connecting arms 364, such that as long as a position provided the second limit structure 3663 can be used to limit the rotation range of the connecting rod 36612, and the appearance and the position of the second limiting structure 3663 can be adjusted according to practical requirements. In other words, in different embodiments, the second limiting structure 3663 can disposed on the connection arm 364.

As shown in FIG. 3 to FIG. 5, when the linkage rotating component 3661 is located at a first position, the second limiting structure 3663 is not in contact with one end of the linkage rod 36612, such that the user can grip the grip portion 366112 and rotate the grip portion 366112 along a first rotation direction R1.

At the same time, the connector 36623 is disposed adjacent to the second limiting structure 3663. When the user rotates the grip portion 366112 along a second rotation direction R2, the connector 36623 is abutting against an inner wall of the elongated through hole, such that the movement range of the connector 36623 is limited, and the slider 36621 cannot move relative to one of the connecting arms 364. The second rotation direction R2 is the reverse direction of the first rotation direction R1. In other words, in the situations shown in FIG. 3 to FIG. 5, when the user rotates the grip portion 366112 to rotate along the second rotation direction R2, the connector 36623 is abutting against the inner wall of the elongated through hole, and the user is clearly feel that the grip portion 366112 is difficult to rotate along the second rotation direction R2.

Conversely, in the situations shown in FIG. 3 to FIG. 5, when the user rotates the grip portion 366112 along the first rotation direction R1, the linkage rotating component 36611 drives the linkage rod 36612 to rotate, and the linkage rod 36612 drives the slider 36621 to slide toward one of the pedals 365 along a first direction L1 relative to one of the connecting arms 364.

As shown in FIG. 17 and FIG. 20 to FIG. 22, FIG. 20 is a schematic partially view showing the slider of the exercise kit located at a second slider position of the multi-functional chair according to the second embodiment of the present disclosure; FIG. 21 is a schematic partially cross-sectional view showing the slider of the exercise kit located at the second slider position of the multi-functional chair according to the second embodiment of the present disclosure; and FIG. 22 is a schematic partially bottom and cross-sectional view showing the slider of the exercise kit located at the second slider position of the multi-functional chair according to the second embodiment of the present disclosure.

As shown in FIG. 3, when the grip portion 366112 is operated by the user to rotate along the first rotation direction R1 and converted to the state shown in FIG. 6, the linkage rotating component 36611 is rotated from a first position shown in FIG. 4 and FIG. 5, to a second position shown in FIG. 7 and FIG. 8, and the linkage rod 36612 is rotated with the linkage rotating component 36611, such that one side of the linkage rod 36612 is abutting to the second limiting structure 3663. At the same time, the slider 36621 is moved from a first slider position shown in FIG. 3 to the second slider position shown in FIG. 6.

In the situations shown in FIG. 6 to FIG. 8, when the user rotates the grip portion 366112 to rotate along the first rotation direction R1, the linkage rod 36612 is abutting against the second limiting structure 3663, and the user is clearly feeling that the grip portion 366112 is difficult to rotate along the first rotation direction R1.

As mentioned above, as shown in FIG. 3 and FIG. 6, the user can simply grip and rotate the grip portion 366112 to move the slider 36621 between the first slider position shown in FIG. 3 and the second slider position shown in FIG. 6, thereby changing the position of one end of one of the two springs 34 can change the amount of resistance obtained by the user after stepping on the pedals 365. In addition, through the design of the first limiting structure 3643 and the second limiting structure 3663, the user can clearly know that the grip portion 366112 has reached a specific position and can no longer be rotated.

It is worth mentioning that since the slider 36621 is provided with the two pipe plugs 36622, no matter the slider 36621 is located at the first slider position or the second slider position, when the user steps on the pedals 365, the slider 36621 is not moved relative to one of the connecting arms 364. Correspondingly, when the user rotates the grip portion 366112 and drives the slider 36621 to move through the linkage rod 36612, the slider 36621 is driven by the linkage rod 36612 (e.g., subjected to external force), and is moved relative to one of the connecting arms 364.

As shown in FIG. 17, it is worth mentioning that, in the present embodiment, the exercise kit 3 can further include two fixing elements 381 and two moving elements 382. It should be noted that the two fixing elements 381 and the two moving elements 382 respectively adopt the same structure in this embodiment. Therefore, for convenience of explanation, the following description only describes one of the two fixing elements 381 and a corresponding one of the two moving elements 382.

The fixing element 381 is fixed to the base 331 of the supporting structure 33, and the moving element 382 is connected to one of the rotating components 361, such that the moving element 382 and the corresponding rotating component 361 are simultaneously rotatable. The fixing element 381 can include at least one groove 3811 and at least one limiting element 3812, and the moving element 382 can include a main body 3821 and at least one protrusion 3822. Moreover, the main body 3821 of the moving element 382 is, for example, a disk-shaped structure, and the protrusion 3822 is formed by outwardly extending from the main body 3821 of the moving element 382. The moving element 382 is pivotally connected to the fixing element 381, and the protrusion 3822 of the moving element 382 is located in the groove 3811 of the corresponding fixing element 381. When the moving element 382 is rotated with the corresponding rotating component 361, and the protrusion 3822 abuts against the limiting element 3812, the protrusion 3822 and the limiting element 3812 are jointly configured to limit the corresponding rotating components 361, such that the corresponding rotating component 361 cannot rotate anymore, thereby achieving the purpose of limiting the rotation range of a corresponding one of the pedal modules 36.

As shown in FIG. 16 and FIG. 17, more specifically, when the user removes their feet from the pedals 365, the springs 34 drive the rotating components 361 to rotate in a direction toward the seat body 1. When the protrusion 3822 abuts against the limiting element 3812 during the corresponding rotating component 361 being rotated in a direction toward the seat body 1, the rotating component 361 is limited by the limiting element 3812 and the protrusion 3822, such that the rotating component 361 cannot rotate in the direction toward the seat body 1. In other words, in practice, the relevant personnel can provide the different positions of the protrusion 3822 and the limiting element 3812 to avoid the issue of pinching the user's feet when the pedals 365 are rotated in the direction toward the seat body 1 by the springs 34.

As mentioned above, the exercise kit 3 of this embodiment through the design of the adjustment modules 366 allows the user to change the position of one end of each of the two springs 34 by operating the adjustment modules 366 according to requirements, thereby changing the resistance of the springs 34 back to the user's feet.

It should be emphasized that the above-mentioned exercise kit 3 of the present disclosure can be manufactured or sold independently, and the exercise kit 3 is not limited to being manufactured or sold together with the seat body 1 and the chair leg module 2.

BENEFICIAL EFFECTS OF THE EMBODIMENT

In conclusion, through the design of the exercise kit that can be detachably disposed at the chair leg modules, the multi-functional chair provided by the present disclosure enables the relevant personnel to easily mount and disassemble the exercise kit from the chair. The design of the exercise kit allows the user to perform training exercises by using the exercise kit.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A multi-functional chair, comprising:

a seat body for a user to be seated thereon;

a chair leg module, including:

a chair leg provided with a plurality of casters and a plurality of braking mechanisms, wherein each of the braking mechanisms is operable by the user to restrict rotation of the casters; and a lifting component connected to the seat body and the chair leg, wherein the lifting component is operable by the user to lift or lower the seat body relative to the chair leg, and the lifting component includes a pneumatic rod; and an exercise kit detachably connected to the chair leg module, wherein the exercise kit is disposed under the seat body, and the exercise kit includes:

a plurality of fixing members, each of the fixing members including at least one auxiliary fixing component and at least one locking component;

a fixing seat including a hollow sleeve and a connecting plate, wherein the hollow sleeve is connected to the connecting plate, the hollow sleeve is configured to be sleeved on an outer side of the pneumatic rod, the connecting plate is disposed at one side of the chair leg facing toward the seat body, multiple ones of the auxiliary fixing component are disposed at another side of the chair leg opposite to the seat body, and multiple ones of the locking component are configured to fix the multiple ones of the auxiliary fixing component and the connecting plate with each other, such that the connecting plate and the multiple ones of the auxiliary fixing component are jointly fixed to the chair leg;

a supporting structure connected to the fixing seat;

two pedal modules, each of the two pedal modules including:

one of two rotating components rotatably connected to the supporting structure;

one of two connecting arms, one end of one of the two connecting arms being fixed to one of the two rotating components; and one of two pedals connected to another end of one of the connecting arms, wherein each of the two pedals is provided for the user sitting on the seat body to step thereon; and two springs, one end of each of the two springs being fixed to the supporting structure, another end of each of the two springs being fixed to one of the two connecting arms;

wherein, when any one of the two pedals is stepped on by the user, one of the corresponding connecting arms and one of the corresponding pedals are rotated relative to the supporting structure, and one of the corresponding springs is stretched.

2. The multi-functional chair according to claim 1, wherein the two rotating components are respectively disposed on two sides of the supporting structure, the two rotating components are located on an axis, the two rotating components are respectively defined as a first rotating component and a second rotating component, each of the two rotating components is a hollow tube, and the exercise kit further includes a synchronous member, which includes:

a linkage rod, wherein one end of the linkage rod is fixed to the first rotating component, another end of the linkage rod is disposed in the second rotating component, and the linkage rod has a threaded hole;

a fixing structure being fixed and disposed on the second rotating component, wherein the fixing structure has a threaded hole, and the threaded hole of the fixing structure is in spatial communication with a through hole of the second rotating component;

a locking structure, wherein a part of the locking structure is fixed to the threaded hole of the linkage rod, and the locking structure is operable by the user, such that the part of the locking structure is fixed to the threaded hole of the linkage rod;

wherein, when the locking structure, the threaded hole of the linkage rod, and the threaded hole of the fixing structure are fixed to each other, the second rotating component, the linkage rod and the first rotating component are synchronously rotatable.

3. The multi-functional chair according to claim 1, wherein the exercise kit further includes two damping rods, the two damping rods are respectively disposed in the two springs, and two ends of each of the damping rods are respectively fixed to one of the two connecting arms and the supporting structure; wherein each of the damping rods is configured to slowly rotate the pedal module, which is no longer stepped on by the user, from a position away from the seat body toward a position adjacent to the seat body.

4. The multi-functional chair according to claim 1, wherein two sides of the supporting structure respectively have two block components, each of the two block components is configured to abut against one of the two connecting arms, such that a gap is formed between the pedal and the seat body.

5. The multi-functional chair according to claim 1, wherein each of the two pedals is rotatably connected to one of the two connecting arms, and each of the two pedals is operable to rotate relative to the two connecting arms between a moving position and a retracted position; wherein, when the two pedals are located at the moving position, the two pedals are configured to be stepped on by the user sitting on the seat body; and wherein, when the two pedals are operated to rotate to the retracted position relative to the two connecting arms, the pedals are located under the seat body, and the two pedals do not protrude from a front edge of the seat body.

6. The multi-functional chair according to claim 1, wherein one side of each of the two pedals away from each other is defined as an outer side, the outer side of each of the two pedals is provided with one of a plurality of auxiliary handles, one of the plurality of the auxiliary handles are configured to provide for the user to grip, such that the user is able to grip the auxiliary handles to rotate the two connecting arms away from the seat body.

7. The multi-functional chair according to claim 1, wherein one side of each of the two pedals facing toward the chair leg is provided with an elastic abutting component; and wherein, when the two pedals are stepped on by the user to rotate in a direction toward the chair leg, the elastic abutting component abuts against the chair leg.

8. The multi-functional chair according to claim 1, wherein the exercise kit further includes a plurality of hook components disposed at one end of one of the two rotating components or the supporting structure, and each of the hook components is configured to allow one end of an exercise resistance band to be attached thereto by the user.

9. The multi-functional chair according to claim 1, wherein the exercise kit further includes two adjust modules, each of the two adjust modules includes:

a manipulating component rotatably disposed on one of the two connecting arms, the manipulating component included a linkage rotating component and a linkage rod, the linkage rotating component rotatably disposed on one of the two connecting arms, one end of the linkage rod pivotally connected to the linkage rotating component, the linkage rotating component included a grip portion, wherein the grip portion is operable by the user, such that the linkage rotating component rotates relative to one of the connecting arms;

a sliding component included a slider, the slider fixed to one end of one of the two springs, wherein the slider is connected with the other end of the linkage rod, and the slider is slidably connected to the connecting arm;

a first limiting structure disposed on the connecting and adjacent to the slider; and a second limiting structure disposed on one of the connecting arms or the linkage rotating component and adjacent to the linkage rotating component;

wherein the linkage rotating component is able to switch between a first position and a second position, when the linkage rotating component switches between the first position and the second position, the slider switches in two different positions relative to one of the two connecting arms; and wherein, when the linkage rotating component is located at the first position, the first limiting structure is able to limited a movement range of the linkage rotating component and the linkage rod; when the linkage rotating component is located at the second position, the second limiting structure is able to be limited by the movement range of the linkage rod.

10. The multi-functional chair according to claim 9, wherein the slider is fixed to one of the two connecting arms through a connector, the first limiting structure is an elongated through hole, the elongated through hole is form from the connecting arm, a part of the connector is through the elongated through hole; and wherein, when the linkage rotating component is located at the first position, a part of the connector is abutting against to one end of the elongated through hole, the linkage rotating component is limited by the linkage rod, such that the linkage rotating component is not able to drive the slider to move along a first direction through the linkage rod.

11. The multi-functional chair according to claim 10, wherein the second limiting structure is fixed and disposed on the linkage rotating component, and the second limiting structure and the linkage rod are fixed to a same side of the linkage rotating component, and the second limiting structure is a protruding structure; and wherein, when the linkage rotating component is located at the second position, the protruding structure is able to abut against the linkage rod, and the protruding structure and the linkage rod abutted with each other are limited by the linkage rotating component, such that the linkage rotating component is not able to drive the slider to move along the second direction through the linkage rod, and the second direction is reverse of the first direction.

12. The multi-functional chair according to claim 9, wherein each of the slider is a hollow structure, the slider is sleeved on one of the two connecting arms, two ends of the slider further respectively provided with one of the two pipe plugs, and the two pipe plugs are configured to assist in limiting a movement range of the slider relative to one of the two connecting arms.

13. The multi-functional chair according to claim 9, wherein, the linkage rotating component included a manipulating portion, when the linkage rotating component is located at the first position, and the manipulating portion are operated by the user to rotate in a direction toward the pedal, the linkage rotating component is switched from the first position to the second position, and the slider is moved in the direction toward the pedal; and wherein, when the linkage rotating component is located at the second position, and the manipulating portion are operated by the user to rotate in a direction away from the pedal, the linkage rotating component is switched from the second position to the first position, and the slider is moved in the direction away from the pedal.

14. An exercise kit for being fixed to an activity chair, wherein the activity chair includes a seat body and a chair leg module, the seat body is provided for a user to be seated thereon, the chair leg module includes a chair leg and a lifting component, the chair leg provided with a plurality of casters and a plurality of braking mechanisms, and each of the braking mechanisms is operable by the user to restrict rotation of the casters; wherein the lifting component connected to the seat body and the chair leg, and the lifting component is operable by the user to lift or lower the seat body relative to the chair leg; wherein the exercise kit is detachably connected to the chair leg module, the exercise kit is disposed under the seat body, and the exercise kit includes:

a plurality of fixing members, each of the fixing members including at least one auxiliary fixing component and at least one locking component;

a fixing seat including a hollow sleeve and a connecting plate, wherein the hollow sleeve is connected to the connecting plate, the hollow sleeve is configured to be sleeved on an outer side of the pneumatic rod, the connecting plate is disposed at one side of the chair leg facing toward the seat body, multiple ones of the auxiliary fixing component are disposed at another side of the chair leg opposite to the seat body, and multiple ones of the locking component are configured to fix the multiple ones of the auxiliary fixing component and the connecting plate with each other, such that the connecting plate and the multiple ones of the auxiliary fixing component are jointly fixed to the chair leg;

a supporting structure connected to the fixing seat;

two pedal modules, each of the two pedal modules including:

one of two rotating components rotatably connected to the supporting structure;

one of two connecting arms, one end of one of the two connecting arms being fixed to one of the two rotating component; and one of two pedals connected to another end of one of the two connecting arms, wherein each of the two pedals is provided for the user sitting on the seat body to step thereon; and two springs, one end of each of the two springs being fixed to the supporting structure, another end of each of the two springs being fixed to one of the two connecting arms;

wherein, when any one of the two pedals is stepped on by the user, one of the corresponding connecting arms and one of the corresponding pedals are rotated relative to the supporting structure, and one of the corresponding springs is stretched.

15. The exercise kit according to claim 14, wherein the two rotating components are respectively disposed on two sides of the supporting structure, the two rotating components are located on an axis, the two rotating components are respectively defined as a first rotating component and a second rotating component, each of the two rotating components is a hollow tube, and the exercise kit further includes a synchronous member, which includes:

a linkage rod, wherein one end of the linkage rod is fixed to the first rotating component, another end of the linkage rod is disposed in the second rotating component, and the linkage rod has a threaded hole;

a fixing structure being fixed and disposed on the second rotating component, wherein the fixing structure has a threaded hole, and the threaded hole of the fixing structure is in spatial communication with a through hole of the second rotating component;

a locking structure, wherein a part of the locking structure is fixed to the threaded hole of the linkage rod, and the locking structure is operable by the user, such that the part of the locking structure is fixed to the threaded hole of the linkage rod;

wherein, when the locking structure, the threaded hole of the linkage rod, and the threaded hole of the fixing structure are fixed to each other, the second rotating component, the linkage rod and the first rotating component are synchronously rotatable.

16. The exercise kit according to claim 14, wherein the exercise kit further includes two damping rods, the two damping rods are respectively disposed in the two springs, and two ends of each of the damping rods are respectively fixed to one of the two connecting arms and the supporting structure; wherein each of the damping rods is configured to slowly rotate the pedal module, which is no longer stepped on by the user, from a position away from the seat body toward a position adjacent to the seat body.

17. The exercise kit according to claim 14, wherein two sides of the supporting structure respectively have two block components, each of the two block components is configured to abut against one of the two connecting arms, such that a gap is formed between the pedal and the seat body.

18. The exercise kit according to claim 14, wherein each of the two pedals is rotatably connected to one of the two connecting arms, and each of the two pedals is operable to rotate relative to the two connecting arms between a moving position and a retracted position; wherein, when the two pedals are located at the moving position, the two pedals are configured to be stepped on by the user sitting on the seat body; and wherein, when the two pedals are operated to rotate to the retracted position relative to the two connecting arms, the pedals are located under the seat body, and the two pedals do not protrude from a front edge of the seat body.

19. The exercise kit according to claim 14, wherein one side of each of the two pedals away from each other is defined as an outer side, the outer sides of each of the two pedals is provided with one of a plurality of auxiliary handles, one of the plurality of the auxiliary handles are configured to provide for the user to grip, such that the user is able to grip the auxiliary handles to rotate the two connecting arms away from the seat body.

20. The exercise kit according to claim 14, wherein one side of each of the two pedals facing toward the chair leg is provided with an elastic abutting component; and wherein, when the two pedals are stepped on by the user to rotate in a direction toward the chair leg, the elastic abutting component abuts against the chair leg.

21. The exercise kit according to claim 14, wherein the exercise kit further includes a plurality of hook components disposed at one end of one of the two rotating components or the supporting structure, and each of the hook components is configured to allow one end of an exercise resistance band to be attached thereto by the user.

22. The exercise kit according to claim 14, wherein the exercise kit further includes two adjust modules, each of the two adjust modules includes:

a manipulating component rotatably disposed on one of the two connecting arms, the manipulating component included a linkage rotating component and a linkage rod, the linkage rotating component rotatably disposed on one of the two connecting arms, one end of the linkage rod pivotally connected to the linkage rotating component, the linkage rotating component included a grip portion, wherein the grip portion is operable by the user, such that the linkage rotating component rotates relative to one of the connecting arms;

a sliding component included a slider, the slider fixed to one end of one of the two springs, wherein the slider is connected with the other end of the linkage rod, and the slider is slidably connected to the connecting arm;

a first limiting structure disposed on the connecting and adjacent to the slider; and a second limiting structure disposed on one of the connecting arms or the linkage rotating component and adjacent to the linkage rotating component;

wherein the linkage rotating component is able to switch between a first position and a second position, when the linkage rotating component switches between the first position and the second position, the slider switches in two different positions relative to one of the two connecting arms; and wherein, when the linkage rotating component is located at the first position, the first limiting structure is able to limited a movement range of the linkage rotating component and the linkage rod; when the linkage rotating component is located at the second position, the second limiting structure is able to be limited by the movement range of the linkage rod.

23. The exercise kit according to claim 22, wherein the first limiting structure is fixed and disposed on the linkage rotating component, and the first limiting structure and the linkage rod are fixed to a same side of the linkage rotating component, and the first limiting structure is a protruding structure; and wherein, when the linkage rotating component is located at the first position, the protruding structure is able to abut against the linkage rod, and the protruding structure and the linkage rod are limited by the linkage rotating component, such that the linkage rotating component is not able to rotate along the same direction.

24. The exercise kit according to claim 23, wherein the slider is fixed to one of the two connecting arms through a connector, the second limiting structure is an elongated through hole, the elongated through hole is form from the connecting arm, a part of the connector is through the elongated through hole; and wherein, when the linkage rotating component is located at the second position, a part of the connector is abutting against to one end of the elongated through hole, and the linkage rotating component is limited by the linkage rod, such that the linkage rotating component is not able to drive the slider to move along the same direction.

25. The exercise kit according to claim 22, wherein each of the slider is a hollow structure, the slider is sleeved on one of the two connecting arms, two ends of the slider further respectively provided with one of the two pipe plugs, and the two pipe plugs are configured to assist in limiting a movement range of the slider relative to one of the two connecting arms.

26. The exercise kit according to claim 22, wherein the linkage rotating component included a manipulating portion, when the linkage rotating component is located at the first position, and the manipulating portion are operated by the user to rotate in a direction toward the pedal, the linkage rotating component is switched from the first position to the second position, and the slider is moved in the direction toward the pedal; and wherein, when the linkage rotating component is located at the second position, and the manipulating portion are operated by the user to rotate in a direction away from the pedal, the linkage rotating component is switched from the second position to the first position, and the slider is moved in the direction away from the pedal.

* * * * *